US007636099B2

(12) United States Patent
Shen et al.

(10) Patent No.: US 7,636,099 B2
(45) Date of Patent: Dec. 22, 2009

(54) DRIVING DEVICE FOR QUICKLY CHANGING THE GRAY LEVEL OF THE LIQUID CRYSTAL DISPLAY AND ITS DRIVING METHOD

(75) Inventors: Yuh-Ren Shen, Tainan (TW); Chun-Chi Chen, Kaohsiung (TW); Cheng-Jung Chen, Miaoli Hsien (TW)

(73) Assignee: VastView Technology Inc., Hsinchu (TW)

( * ) Notice: Subject to any disclaimer, the term of this patent is extended or adjusted under 35 U.S.C. 154(b) by 0 days.

(21) Appl. No.: 12/122,084

(22) Filed: May 16, 2008

(65) Prior Publication Data

US 2008/0211829 A1 Sep. 4, 2008

Related U.S. Application Data

(62) Division of application No. 10/929,564, filed on Aug. 31, 2004, now abandoned.

(51) Int. Cl.
*G09G 5/10* (2006.01)

(52) U.S. Cl. ..... 345/690; 345/691; 345/692

(58) Field of Classification Search ..... 345/76, 345/87, 89, 94, 96, 98, 99, 100, 102, 103, 345/204, 211, 213, 589, 690, 691, 692; 234/98; 257/59; 359/645; 349/38, 139
See application file for complete search history.

(56) References Cited

U.S. PATENT DOCUMENTS

| | | | | |
|---|---|---|---|---|
| 5,748,164 | A * | 5/1998 | Handschy et al. | 345/89 |
| 5,949,396 | A * | 9/1999 | Lee | 345/87 |
| 6,903,716 | B2 * | 6/2005 | Kawabe et al. | 345/100 |
| 7,038,651 | B2 * | 5/2006 | Nitta et al. | 345/98 |
| 7,355,666 | B2 * | 4/2008 | Song et al. | 349/144 |
| 7,420,550 | B2 * | 9/2008 | Yuh-Ren et al. | 345/204 |
| 7,425,937 | B2 * | 9/2008 | Inukai | 345/76 |
| 7,508,479 | B2 * | 3/2009 | Kim et al. | 349/149 |
| 2003/0030609 | A1 * | 2/2003 | Lee | 345/87 |
| 2003/0043104 | A1 * | 3/2003 | Lee et al. | 345/92 |
| 2003/0090614 | A1 * | 5/2003 | Kim et al. | 349/149 |
| 2004/0263457 | A1 * | 12/2004 | Liu | 345/89 |
| 2005/0024353 | A1 * | 2/2005 | Amundson et al. | 345/204 |
| 2005/0219188 | A1 * | 10/2005 | Kawabe et al. | 345/94 |
| 2006/0044241 | A1 * | 3/2006 | Yuh-Ren et al. | 345/89 |

* cited by examiner

*Primary Examiner*—Prabodh M Dharia
(74) *Attorney, Agent, or Firm*—Muncy, Geissler, Olds & Lowe, PLLC

(57) ABSTRACT

A driving device for quickly changing the gray level of the liquid crystal display (LCD and its driving method are disclosed. The driving device includes a group of thin film transistors with matrix array, a plurality of gate lines and a plurality of data lines. The object of quickly changing the gray level of the LCD can be accomplished by the different arrangement of the gate lines and the data lines and the different connection of the thin film transistors with the gate lines and the data lines. The driving method includes: two gate lines in the LCD are simultaneously or synchronously turned on according to in the bright, period or in the black, period, the voltage for displaying the present frame interval data or the voltage for displaying black image is given to the thin film transistors connected with the gate lines, and scanning continues in turn.

3 Claims, 27 Drawing Sheets

DRIVING DEVICE FOR QUICKLY CHANGING THE GRAY LEVEL OF THE LIQUID CRYSTAL DISPLAY AND ITS DRIVING METHOD

This application is a Divisional application of U.S. application Ser. No. 10/929,564 entitled "DRIVING DEVICE FOR QUICKLY CHANGING THE GRAY LEVEL OF THE LIQUID CRYSTAL DISPLAY AND ITS DRIVING METHOD"and filed on 31 Aug. 2004.

BACKGROUND OF THE INVENTION

1. Field of the Invention

The present invention relates to a driving device for quickly changing the gray level of the liquid crystal display and its driving method, especially to a display driving device and its driving method, which can simultaneously or synchronously drive a plurality of thin film transistors, wherein the source and the gate of each thin film transistor in the driving device are respectively connected with different gate lines and data lines to let the specific transistor be driven by the gate driver and the source driver, and the voltage of displaying the present frame interval data or the voltage of displaying black image is applied to accomplish the object of quickly changing the gray level of the liquid crystal display. The present invention can suit for the picture treatment of various liquid crystal displays, organic light emitting diode (OLED) display or plasma display panel (PDF).

2. Description of the Prior Art

Because the liquid crystal display possesses the advantages of low power consumption, light of mass, thin thickness, without radiation and flickering, it gradually replaces the traditional cathode ray tube (CRT) display in the display market. The liquid crystal display is chiefly used as the screen of the digital television, the computer or the notebook computer. In particular, the large sized liquid crystal display is widely used in the amusements of the life, especially in the field in which the view angle, the response speed, the color number, and the image of high quality are in great request. But there exist some limitations and drawbacks due to the properties of the liquid crystal molecules such as viscosity, elasticity, and dielectricity etc.

Referring to FIGS. 1A and 1B, they are the simple schematic views showing the internal structure of the prior liquid crystal display. Mark 10 is the display panel. The data driver 11 is installed above the display panel, which can change the data of the adjusted gray level signal into the corresponding data voltage. The image signal can be transferred to the display panel 10 through the plurality of data lines 111 connected with the source driver 11. The gate driver 12 is installed on one side of the display panel 10, which can continuously provide scanning signal. The scanning signal can be transferred to the display panel 10 through the plurality of gate lines 121 connected with the gate driver 12. The data line 111 and the gate line 121 are orthogonally crossed and insulated with each other. The area enclosed in them is a pixel 13.

After the image signal is output from the data driver 11, it will get to the source of the thin film transistor $Q_1$ in the pixel. 13 through the data line $D_1$, and a control signal is correspondingly output from the gate driver 12, it will get to the gate of the thin film transistor $Q_1$ through the gate line $G_1$. The circuit in the pixel 13 will output the output voltage to drive the liquid crystal molecular corresponding to the pixel 13, and a parallel plate type capacitor $C_{LC}$ (capacitor of liquid crystal) will be formed by the liquid crystal molecules between the two pieces of glass substrates in the display panel 10. Because the capacitor $C_{LC}$ cannot keep the voltage to the next time of renewing the frame data, so there is a storage capacitor $C_S$ provided for the voltage of the capacitor being able to be kept to the next time of renewing the frame data. This display mode is called "Hold type".

Although the brightness between the frame and the next frame in the liquid crystal display can be kept and the flickering phenomenon of the frame in the traditional CRT display cannot be produced, there still exists another problem of afterimage phenomenon. It can be explained with FIG. 2. If the brightness of the four frames $F_1$, $F_2$, $F_3$, and $F_4$ in the time axis are be displayed on the liquid crystal display, the pixels of the panel need be driven by the source drivers and the gate drivers of the liquid crystal display to change the brightness of the panel. Because there exists a response time for the rotation of the driven liquid crystal molecules, the brightness will change with the time as shown by curve (a) in FIG. 2. After the expected brightness is reached, the brightness is maintained by the voltage of displaying the frame. If the response speed of the liquid crystal molecular is not quick enough, the image of the preceding frame and the image of the following frame will overlap each other to blur the image, i.e. the afterimage phenomenon. Especially when the ascending speed is quicker than the descending speed in the brightness variation of the liquid crystal display, the afterimage phenomenon during the frame change can be easily produced.

The color of the traditional CRT display is produced by the strike of the electron beam on the screen coated with phosphorescent material. The color produced by excitement occurs instantaneously and disappears quickly. The excitement for the image of the following frame is continued. This is the so-called impulse type display. The brightness variation of its display is shown as curve (b) in FIG. 2. Therefore, no afterimage occurs between the frame and the following frame. But if the scanning frequency of the CRT display is not quick enough, the flickering phenomenon will be produced.

The resolve the drawback of the afterimage phenomenon of LCD and possess the advantage of the impulse type CRT, at present there is a pseudo impulse type technique for the display of the image data. Referring to FIG. 3, the said object can be accomplished by two techniques in theory stated as below:

(1) The black color data or the black image is inserted in the continuous image frame: if $F_1$, $F_2$, $F_3$, and $F_4$ are the frames of the series of continuous image, the black images $B_1$, $B_2$, and $B_3$ can be inserted between the continuous image frames with a multiple scanning frequency. After the expected brightness of the display is reached, it can be removed by the black image data. This method can simulate the display of CRT.

(2) The black image signal is inserted in the back light source to make the back light source flicker: The brightness of every frame is originally provided by the light source at the back of the display panel. If $L_1$, $L_2$, $L_3$, and $L_4$ are the continuous back light source and the black image signals are inserted between the back light sources, the light source can be forced to close and produce the black image $B_1$, $B_2$, and $B_3$. This method can also get the effect of simulating the display of CRT and remove the afterimage phenomenon.

Therefore, the present invention discloses a driving device for quickly changing the gray level of the liquid crystal display and its driving method to simulate the pulse type display of CRT and remove the afterimage phenomenon of the liquid crystal display.

In view of this, the inventor had the motive to try and develop the present invention after hard study.

SUMMARY OF THE INVENTION

The chief object of the present invention is to provide a driving device for quickly changing the gray level of the liquid crystal display in which the source and the gate of each thin film transistor are respectively connected to the data line and the gate line with different signals. Executing the driving method for the driving device in the display panel, the objects of increasing the changing speed of the gray level of the liquid crystal display, increasing the aspect ratio of the panel, and decreasing the number of the source drivers and the data lines can be accomplished.

Another object of the present invention is to provide a driving method for quickly changing the gray level of the liquid crystal display in which two row of thin film transistors in the display panel can be simultaneously or synchronously turned on and the voltage of displaying the present frame and the voltage of displaying the black image can be respectively applied. The brightness of the pixel first rises to the expected value and then falls down in the pseudo impulse type display mode hence the object of quickly changing the gray level can be accomplished.

To accomplish the said objects of the present invention, the basic structure of the driving device of the present invention includes a group of thin film transistors with matrix array, gate lines connected with the gate drivers and insulated with each other, and data lines connected with the source drives and insulated with each other, wherein the gates and the sources of ail the thin film transistors are respectively connected with the gate lines and the data lines. The thin film transistors at different locations in the liquid crystal display can be simultaneously or synchronously driven and can be respectively given the voltage of displaying the present frame and the voltage of displaying the black image by the different arrangement of the gate lines and the data lines and by the different connection between the gate lines and the gates of the thin film transistors and between the data lines and the sources of the thin film transistors. The gate drivers can be respectively installed on the left side and the right side of the liquid crystal panel and the drivers can be respectively installed on the upper side and the lower side. The gate driver can be a chip installed on glass or an integrated gate driver circuit installed on glass.

The driving method for the said driving device includes: the period of the voltage of displaying the present frame interval data received by the thin film transistors connected with the first gate line is set as the displaying brightness period and the period of the voltage of displaying black image received by the thin film transistor connected with the first gate line is set as the displaying black image period.

When time enters the displaying brightness period $t_1$, two gate lines in the liquid crystal display are turned on in a time of one synchronous control signal or by the control signals simultaneously produced by the gate drivers. The voltage of displaying the present frame is given to the thin film transistors connected with one of the gate lines which are simultaneously or synchronously turned on, the voltage of displaying the present frame interval data is given to the thin film transistors connected with the other of the gate lines which are simultaneously or synchronously turned on, and scanning continues in turn.

When time enters the displaying black image period $t_2$, two gate lines in the liquid crystal display are orderly turned on in a time of one synchronous control signal or by the control signals simultaneously produced by the gate drivers. One of the gate lines is the next gate line of the last gate line given to the said voltage of the present frame. The voltage of displaying the present frame is given to the thin film transistors connected with the said gate line to the last gate line of the display panel, and the voltage of displaying black image is given to the thin film transistors connected with the first gate line. Scanning continues in turn until the liquid crystal display is wholly scanned, and the next frame interval begins.

If the ratio of the number of the gate lines scanned in the displaying brightness period to the number of the total gate lines is P and the period of the frame interval of the liquid crystal display is T, then the duration of displaying brightness is PT and the duration of displaying black image is (1−P)T. The ratio P can be adjusted according to the characteristic of the display panel.

From the statement stated above, the present invention possesses the characteristic of dividing the space of the gate lines of the display panel into a plurality of regions and the time of the frame interval into a plurality of sub-region times. Each region is orderly scanned in a time of one synchronous control signal. Therefore, the state of "frame in frame" is formed in the space and the time. The method of the present invention can suit for various picture treatments of liquid crystal display, organic light emitting diode (OLED) display or plasma display panel (PDP).

To make the present invention be able to be clearly understood, there are some preferred embodiments and their accompanying draws described in detail as below.

DETAILED DESCRIPTION OF THE PREFERRED EMBODIMENT

Figure 1A:
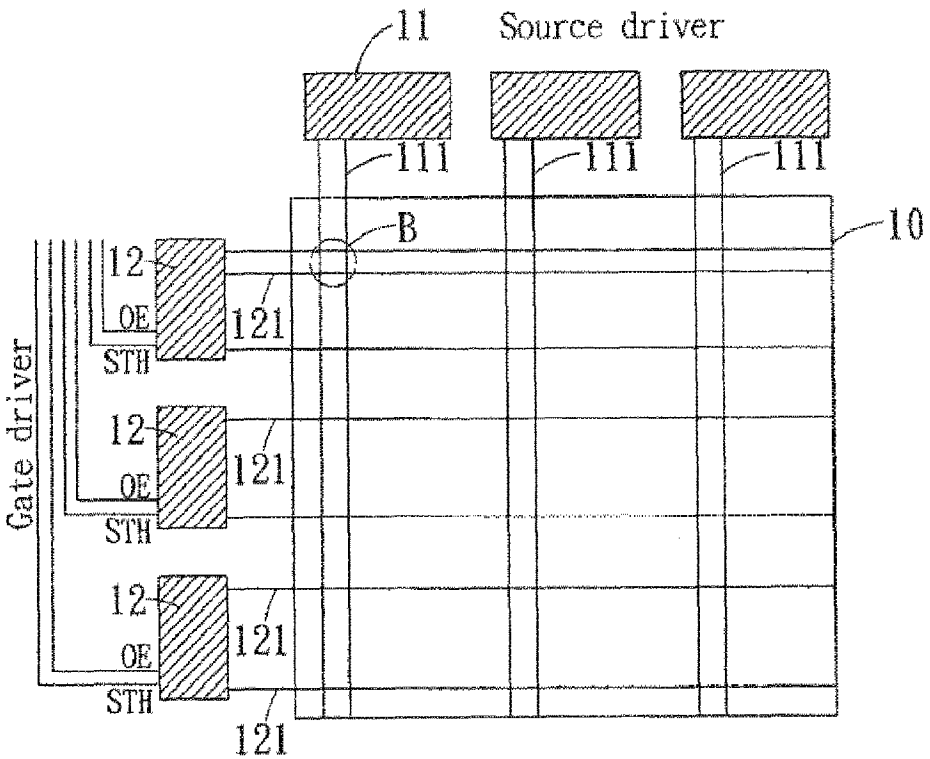
Fig. 1A (Prior Art)
FIG. 1A is a simple schematic view of the structure of the general liquid crystal display.
Figure 1B:
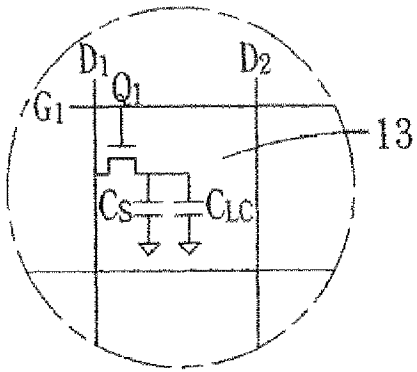
Fig. 1B (Prior Art)
FIG. 1B is an enlarged schematic sectional view taken from FIG. 1A, which shows the arrangement of the elements in the area enveloped in the data lines and the gate lines.
Figure 2:
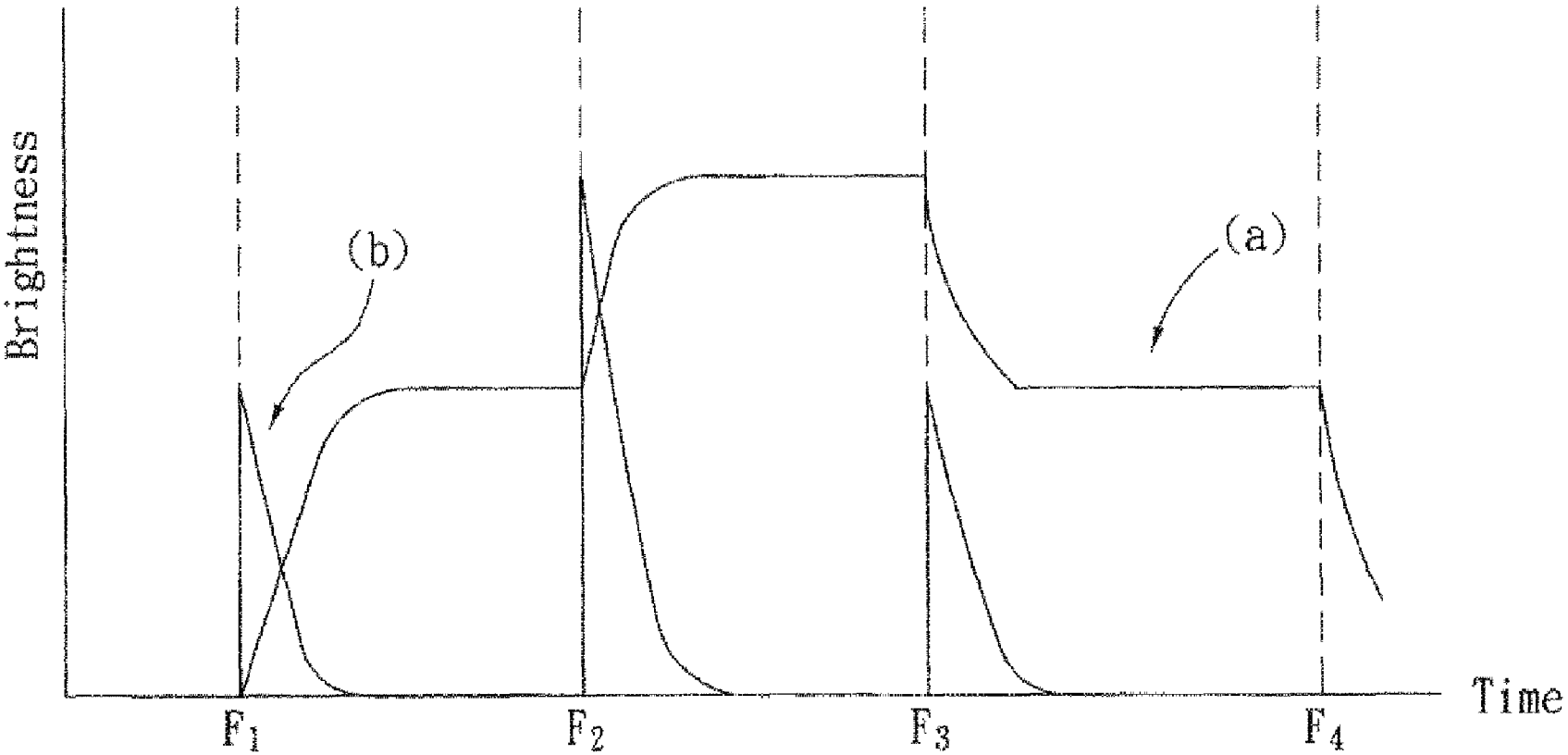
Fig. 2 (Prior Art)
FIG. 2 is a comparison view, wherein curve (a) shows the brightness variation of the liquid crystal display and curve (b) shows the brightness variation of the traditional CRT display.
Figure 3:
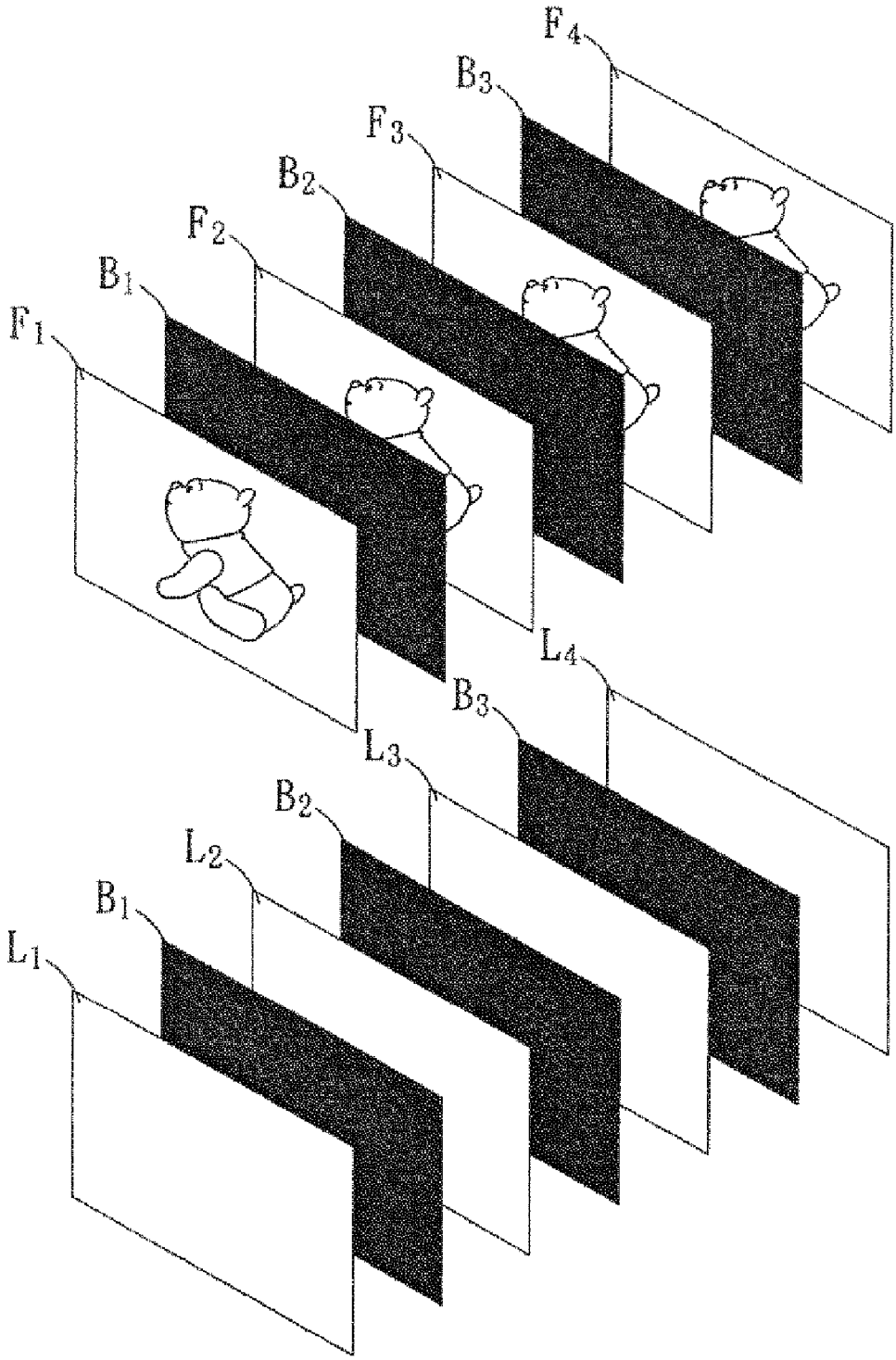
Fig. 3 (Prior Art)
FIG. 3 is a schematic view showing the two chief display modes of pseudo pulse in the prior image display technique of the liquid crystal display.
Figure 4:
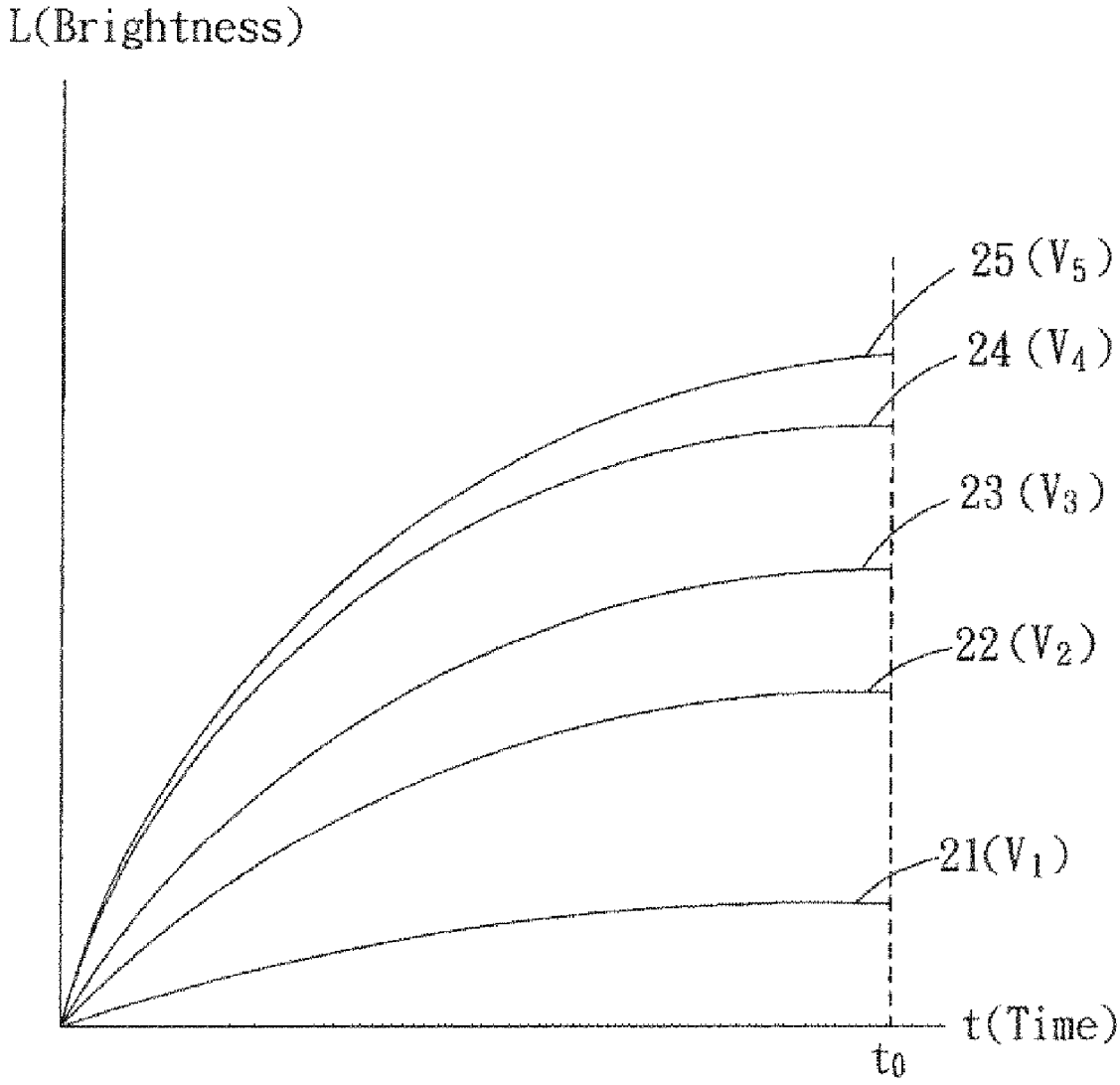
Fig. 4 (Prior Art)
FIG. 4 is a curve view showing the variation of the image brightness versus time at different driving voltages.

Referring to FIG. 4, because various liquid crystal display panels possess different characteristics of photoelectronic reaction, the design of driving IC for the liquid crystal display panel would consider these characteristics. In FIG. 4, if the display is driven by voltage $V_5$ and reaches the expected brightness of some code in the time $t_0$, the variation of its brightness is shown as the curve with mark 25 and is recorded. In the same manner, the liquid crystal display is driven by different voltage $V_1$, $V_2$, $V_3$, and $V_4$ and reaches each expected brightness in the time $t_0$. The brightness variation of each image versus time is shown as the curves of 21, 22, 23, and 24. In general, the higher the voltage value, the faster the brightness variation. The number of the measurement for the voltage versus brightness variation is decided by the requirement. The data of the voltage versus brightness variation for the display panel can be made into a lookup table to be a base for setting the brightness of the panel driven.

When the gray level value of the display is zero, it means that the frame is completely black. In the present invention, when the gray level of the display is under some value, for example code 5~10, it can be regarded as black image. But the black image or the voltage, which make frame black, is still expressed by code 0 in the following statement.

The First Embodiment

Figure 5A:
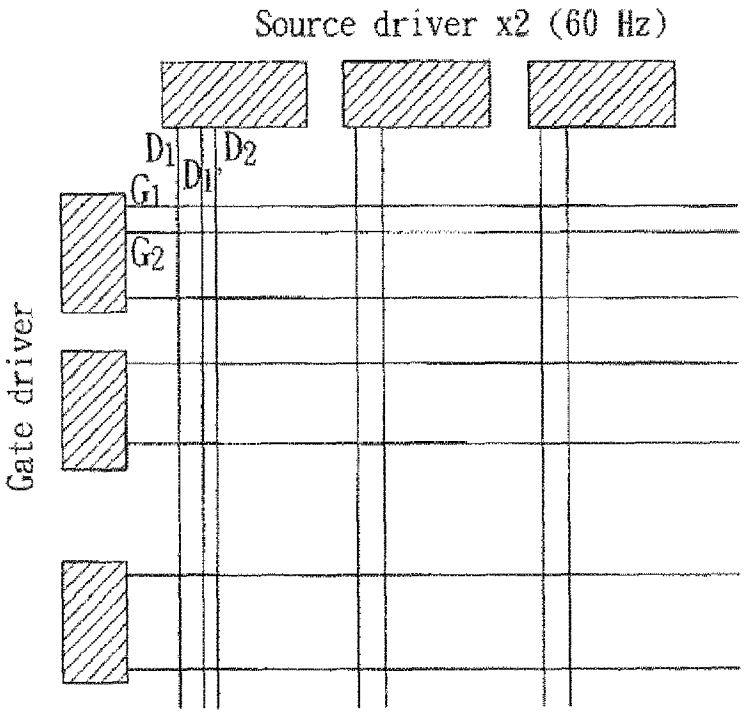
FIG. 5A is a schematic view showing the arrangement of the gate lines and the data lines of the display panel of the first embodiment according to the present invention.
Figure 5B:
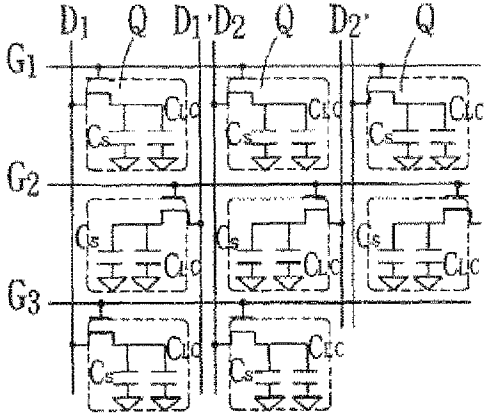
FIG. 5B is an enlarged schematic sectional view taken from FIG. 5A, which shows the arrangement of the gate lines and the data lines and the state of the gate and the source, which are connected to the gate lines and the data lines, of each thin film transistor.
Figure 5C:
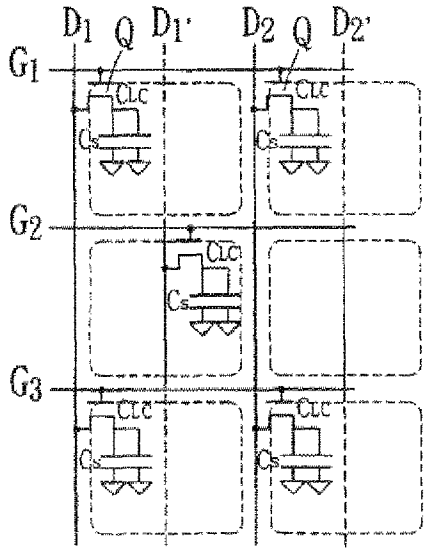
FIG. 5C is an enlarged schematic sectional view taken from FIG. 5A, which shows there is a space between the neighboring data lines for preventing them from short circuit.

Referring to FIG. 5A to 5C they show a preferred embodiment of the driving device for quickly changing the gray level of the liquid crystal according to the present invention. The driving device includes a group of thin film transistors Q with matrix array, which consists of N rows and M columns of thin film transistors, wherein, each thin film transistor Q can drive one pixel, so there are N×M pixels (shown by rectangle with dotted line) can be driven. The first gate line $G_1$ is connected with the gates of all the thin film transistors Q of the first row, the second gate line $G_2$ is connected with the gates of all the thin film transistors Q of the second row, and so are the others. Therefore, there are N gate lines connected to gate driver and they are insulated with each other.

The first and the second data lines $D_1$, $D_{1'}$ of the first group of data lines are respectively connected with the sources of all the thin film transistors Q of the odd and the even rows of the first column. The first and the second data lines $D_2$, $D_{2'}$ of the second group of data lines are respectively connected with the sources of all the thin film transistors Q of the odd and the even rows of the second column and so are the others. Therefore, in total there are M groups of data lines connected to the data drivers and they are insulated with each other. To prevent the neighboring data lines from short circuit, for example, the second data line $D_{1'}$ of the first group of data lines and the first data line $D_2$ of the second group of data lines, a space is given between the neighboring data lines, of which arrangement is shown as FIG. 5C.

Figure 6A:
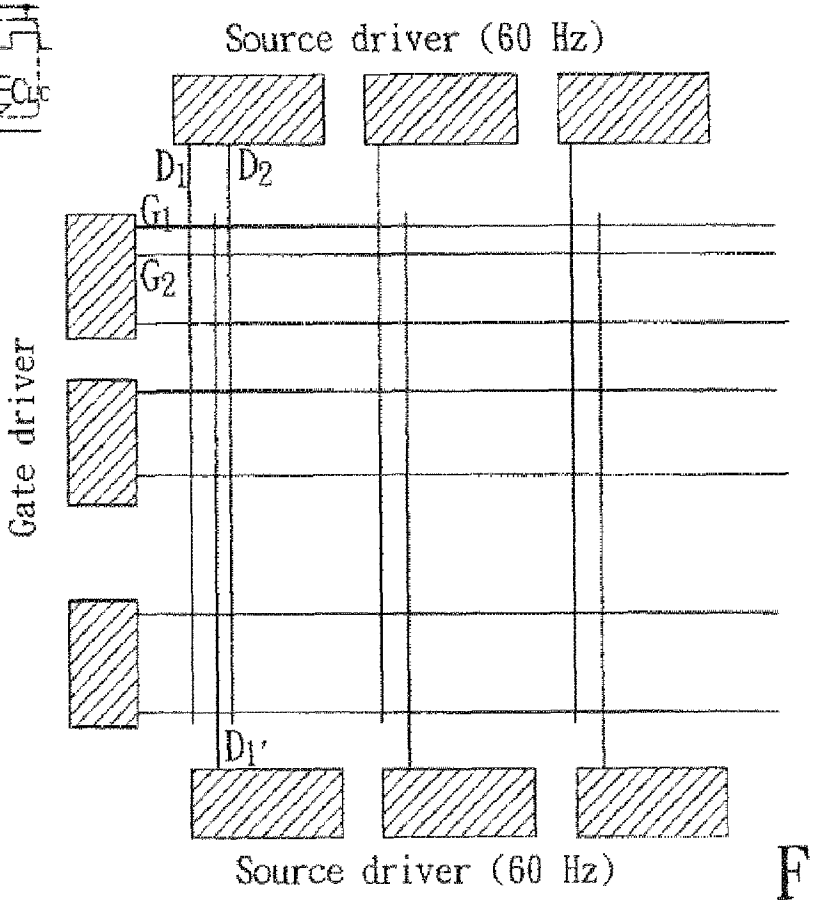
FIG. 6A is a schematic view of the arrangement of the gate lines and the data lines of the display panel of the first embodiment according to the present invention, which shows the state of the source drivers respectively installed on the upper side and the lower side of the display panel.
Figure 6B:
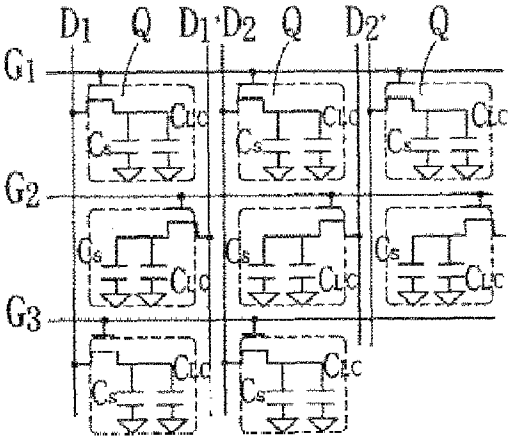
FIG. 6B is an enlarged schematic sectional view takers from FIG. 6A, which shows the arrangement of the gate lines and the data lines and the state of the gate and the source, which are connected to the gate lines and the data lines, of each thin film transistor.
Figure 7A:
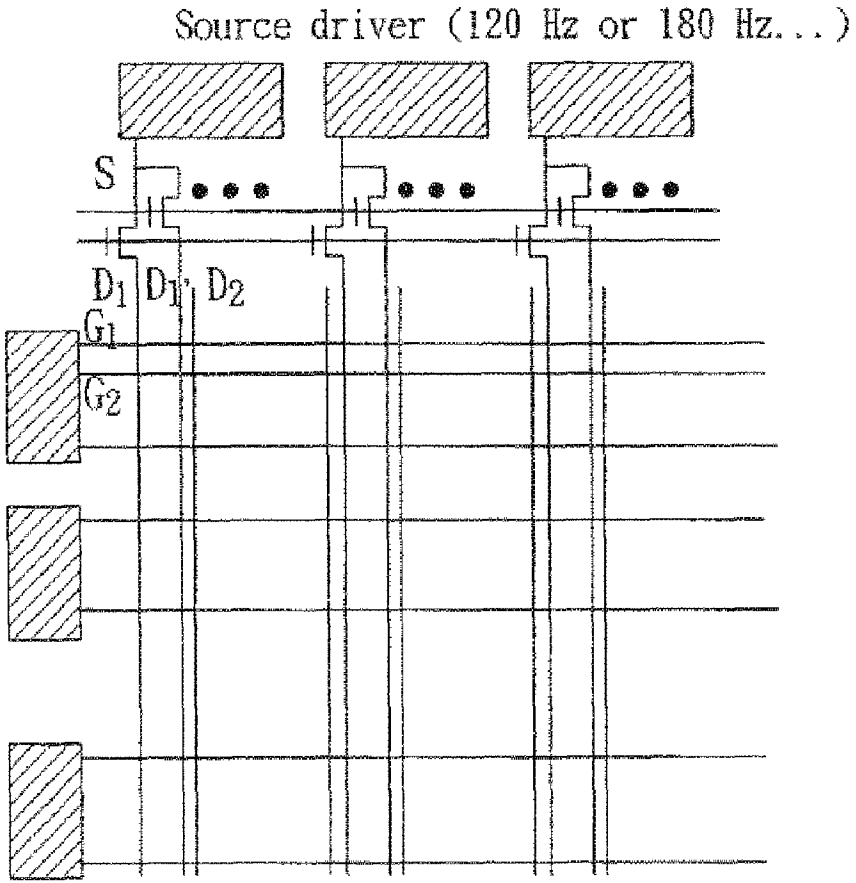
FIG. 7A is a schematic view of the arrangement of the gate lines and the data lines of the display panel of the first embodiment according to the present invention, which shows the state of each pair of data lines connected to a source driver, which is connected to the electronic switch.
Figure 7B:
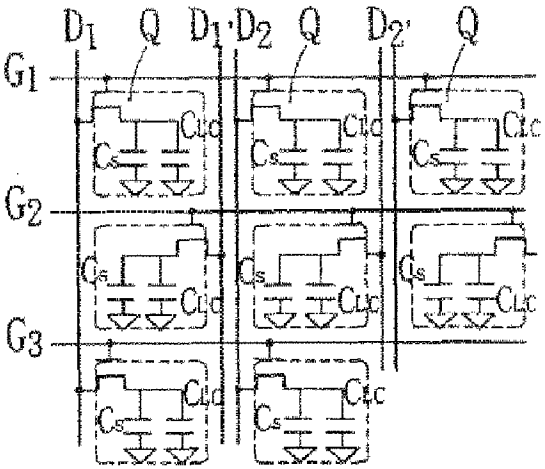
FIG. 7B is an enlarged schematic sectional view taken from FIG. 7A, which shows the arrangement of the gate lines and the data lines and the state of the gate and the source, which are connected to the gate lines and the data lines, of each thin film transistor.

As shown in FIG. 5A, the source drivers connected with the data lines are installed on the same side of the display panel. If the scanning frequency is 60 Hz and there are two gate lines being turned on at the same time, the scanning time can be further decreased. Referring to FIGS. 6A and 6B, the source drivers are respectively arranged on the upper and the lower sides of the liquid crystal display, and the first and the second data line of each group of data lines are respectively connected with the source drivers of the upper and the lower sides of the liquid crystal display, wherein, the scanning frequency of the source drivers is kept at 60 Hz. Referring to FIGS. 7A and 7B, the first data line and the neighboring second line of each group of data lines are connected with the same source driver, and the data transfer is switched by an electronic switch S of which scanning frequency is a multiple of 60 Hz, such as 120 Hz, 180 Hz . . . etc. The form of the gate driver can be a chip on glass or an integrated gate driver circuit on glass.

Figure 8:
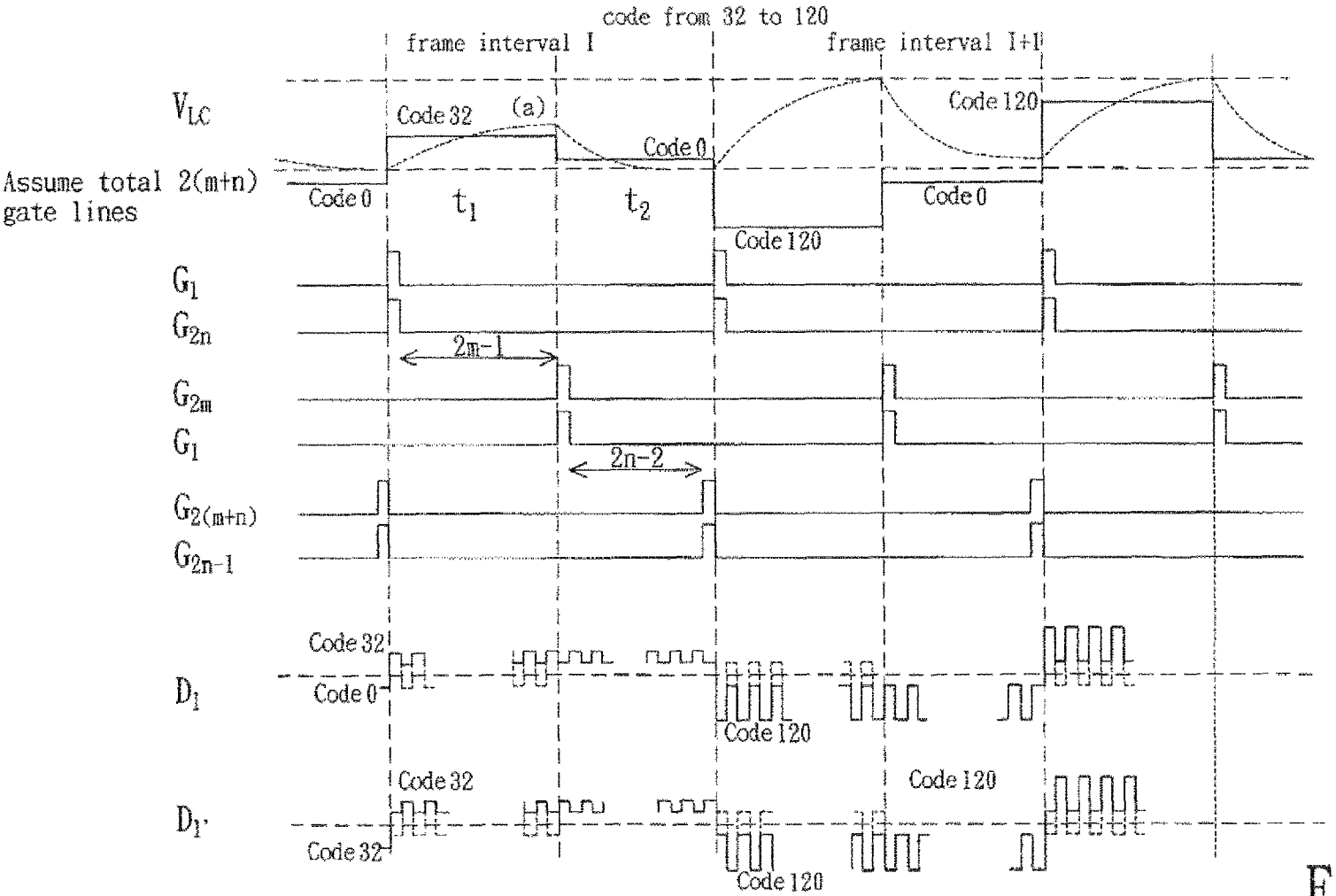
FIG. 8 is a wave form view of the signal used in the driving method of the display device of the first embodiment according to the present invention, which shows the variation of the wave form of the signal of the gate lines and the data lines from the gate driver and the source driver at different frame interval time.

Referring to FIG. 8, in the driving method of the present invention executed by the said device, when time enters the present frame interval 1 from the preceding frame interval, the expected brightness is code 32 and $V_{LC}$ is the driving voltage pulse, the voltage wave form has positive and negative phases due to the driving voltage of the liquid crystal being alternating current. The voltage value will be expressed with code in the following statement. In FIG. 8, curve (a) represents the brightness variation of the pixel after being driven. If there are 2(m+n), i.e. N=2(m+n), gate lines in the liquid crystal display, the period of the voltage of displaying the present frame interval data for the thin film transistor connected with the first gate line is set as the displaying brightness period $t_1$, and the period of the voltage of displaying black image received by the thin film transistor connected with the first gate line is set as displaying black image period $t_2$.

When the frame interval time T enters the displaying brightness period $t_1$, the first gate line $G_1$ and the $2n^{th}$ gate line $G_{2n}$ are simultaneously turned on, and the voltage code 32 of displaying the present frame data is given to the thin film transistor connected to the first gate line $G_1$, the voltage code 0 of the preceding frame is given to the thin film transistor Q connected to the $2n^{th}$ gate line $G_{2n}$, in other words, the gate driver gives the control voltage pulse to the first gate line $G_1$ and the $2n^{th}$ gate line $G_{2n}$ at the same time, the source driver gives the voltage code 32 of displaying the present, frame data to the thin film transistor Q connected to the first gate line $G_1$, the voltage code 0 of the preceding frame data is given to the thin film transistor Q connected to the $2n^{th}$ gate line $G_{2n}$.

In the same manner, the second and the $2n+1^{th}$ gate lines, the third and the $2n+2^{th}$ gate lines . . . the $2m-1^{th}$ and the $2(n+m)-2^{th}$ gate lines are turned on in order, and the voltage code 32 of displaying the present frame data is given to the thin film transistors Q connected to the second to the $2m-1^{th}$ gate lines, the voltage code 0 of the preceding frame data is given to the thin film transistors Q connected to the $2n+1^{th}$ to the $2(m+n)-2^{th}$ gate lines.

When time enters the displaying black image period $t_2$, the $2m^{th}$ and the first gate lines $G_{2m}$, $G_1$, are simultaneously turned on, and the voltage code 32 of displaying the present frame data is given to the thin film transistor Q connected to the $2m^{th}$ gate line $G_{2m}$, the voltage code 0 of displaying black image is given to the thin film transistor Q connected to the first gate line $G_1$. In the same manner, the $2m+1^{th}$ and the second gate lines, the $2m+2^{th}$ and the third gate lines . . . the $2(m+n)^{th}$ (the last) and the $2n-1^{th}$ gate lines are turned on in order, and the voltage code 32 of displaying the present frame data is given to the thin film transistors Q connected to the $2m+1^{th}$ to the $2(m+n)^{th}$ (the last) gate lines, the voltage of displaying black image is given to the thin, film transistors connected to the second to the $2n-1^{th}$ gate lines.

If the ratio of the number of the gate lines which were scanned in the displaying brightness period to the number of the total gate lines is P and the period of the frame interval of the liquid crystal display is T, then the duration of the displaying brightness is PT and the duration of the keeping brightness is (1−P)T. The ratio P can be adjusted according the characteristic of the display panel.

When time enters the next frame interval I+1 and the expected brightness is code 120, the steps stated above can be repeated and the object of quickly changing the gray level of the liquid crystal display can be accomplished.

The Second Embodiment

Figure 9A:
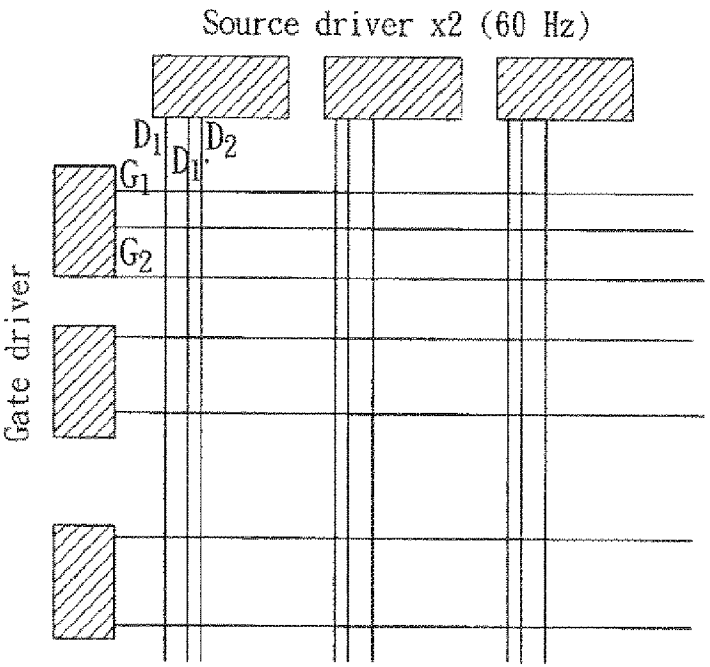
FIG. 9A is a schematic view of the arrangement of the gate lines and the data lines of the display panel of the second embodiment according to the present invention.
Figure 9B:
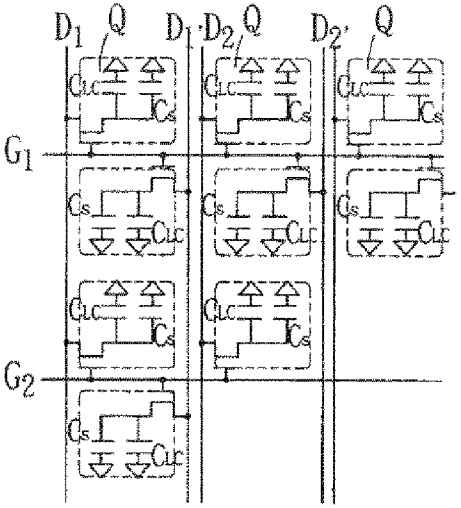
FIG. 9B is an enlarged schematic sectional view taken from FIG. 9A, which shows the arrangement of the gate lines and the data lines and the state of the gate and the source, which are connected with the gate lines and the data lines, of each thin film transistor.
Figure 9C:
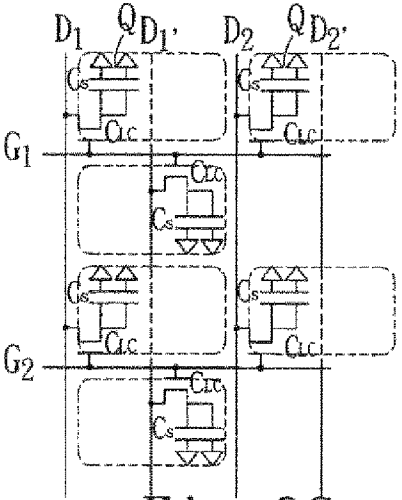
FIG. 9C is an enlarged schematic sectional view taken from FIG. 9A, which shows there is a space between the neighboring data lines for preventing them from short circuit.

Referring to FIG. 9A to 9C, the second embodiment of the driving device for quickly changing the gray level of the liquid crystal display according to the present invention includes a group of thin film transistors with matrix array, which consist of 2N rows and M columns of thin film transistors Q, wherein, each thin film transistor Q can drive one pixel so that there are 2N×M of pixels (shown by the rectangle with dotted line) can be driven in total. The first gate line $G_1$ is connected with the gates of all the thin film transistors Q of the first and the second rows, the second gate line $G_2$ is connected with the gates of all the thin film transistors Q of the third and the fourth rows, and so are the others. Therefore, total N gate lines connected to the gate drivers and insulated with each other.

The first and the second data lines $D_1$, $D_{1'}$ of the first group of data lines are respectively connected with, the sources of all the thin film transistors of the odd rows and the even rows of the first column, the first and the second data lines $D_2$, $D_{2'}$ of the second group of data lines are respectively connected with the sources of all the thin film transistors of the odd and the even rows of the second column and so are the others. Therefore, in total there are M groups of data lines connected to the data drivers and they are insulated with each other. To prevent the neighboring data lines from short circuit, for example, the second data line $D_{1'}$ of the first group of data lines and the first data line $D_2$ of the second group of data lines, there is a space between the neighboring data lines, of which arrangement is shown in FIG. 9C. By this design, the aspect ratio of the liquid crystal display can be increased.

Figure 10A:
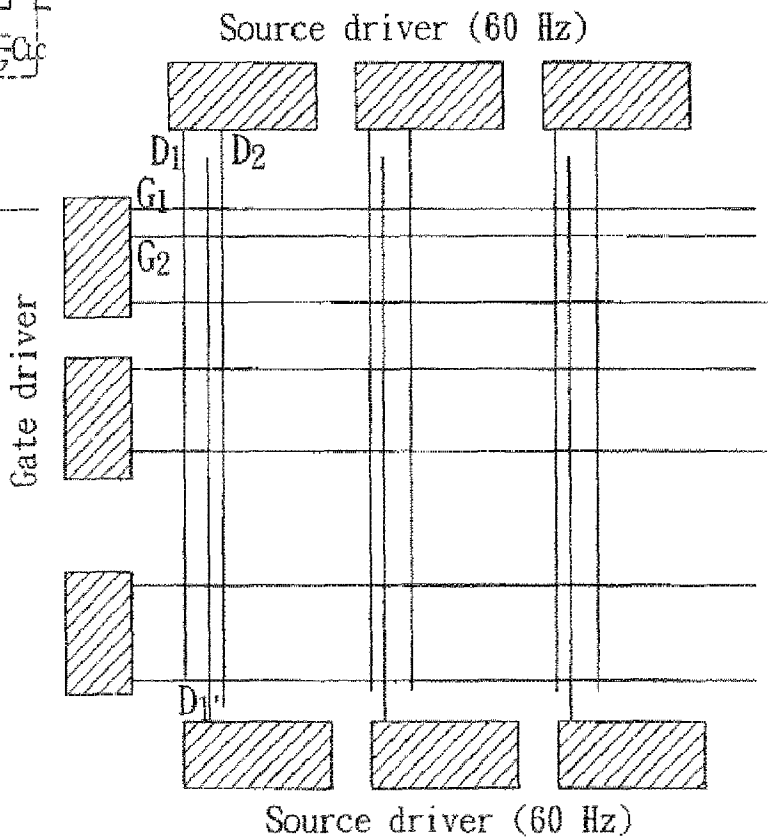
FIG. 10A is a schematic view of the arrangement of the gate lines and the data lines of the display panel of the second embodiment according to the present invention, which shows the state of the source drivers respectively installed on the upper side and the lower side of the display panel.
Figure 10B:
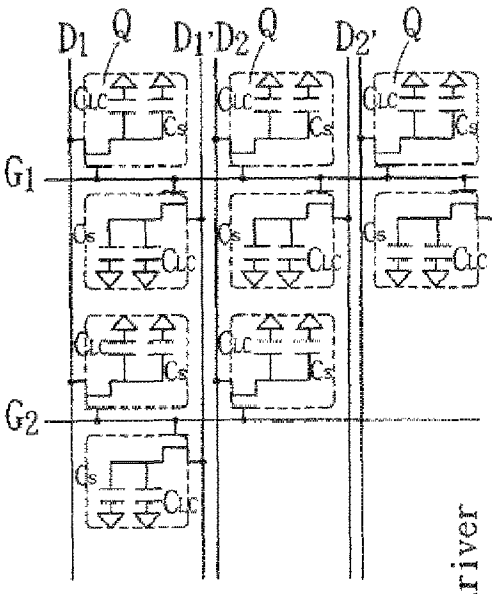
FIG. 10B is an enlarged schematic sectional view taken from FIG. 10A, which shows the arrangement of the gate lines and the data lines and the state of the gate and the source, which are connected with the gate lines and the data lines, of each thin film transistor.
Figure 11A:
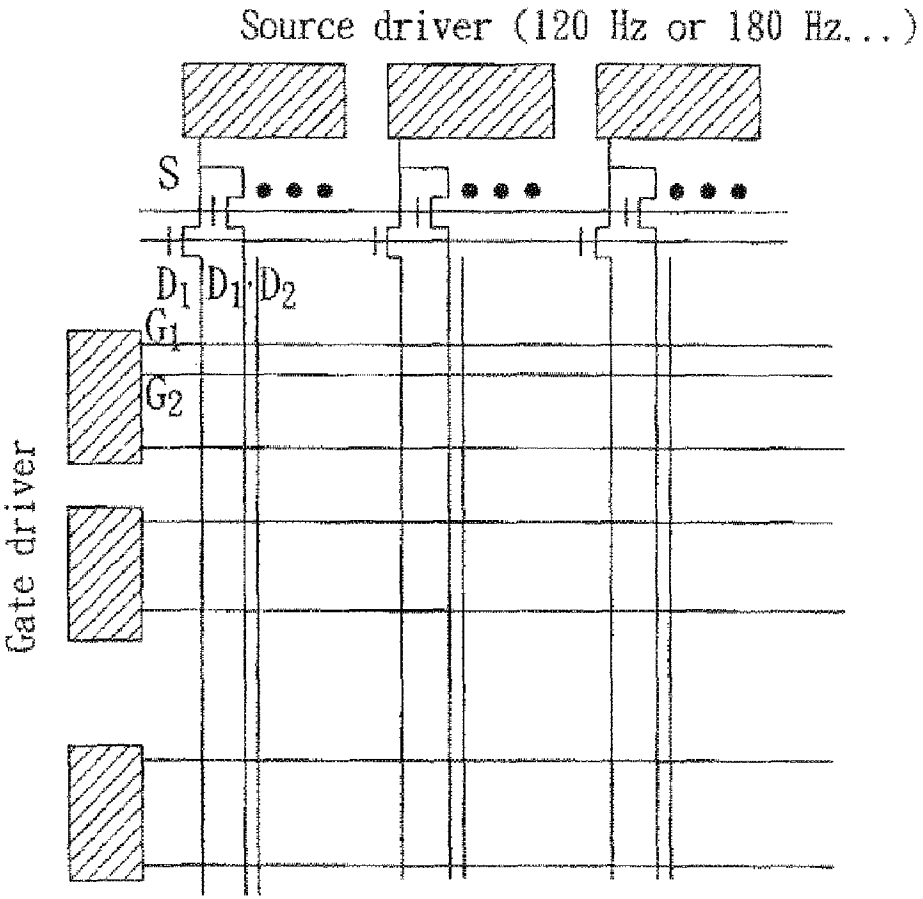
FIG. 11A is a schematic view of the arrangement of the gate lines and the data lines of the display panel of the second embodiment according to the present invention, which shows the state of each pair of data lines connected to a source driver, which is connected to the electronic switch.
Figure 11B:
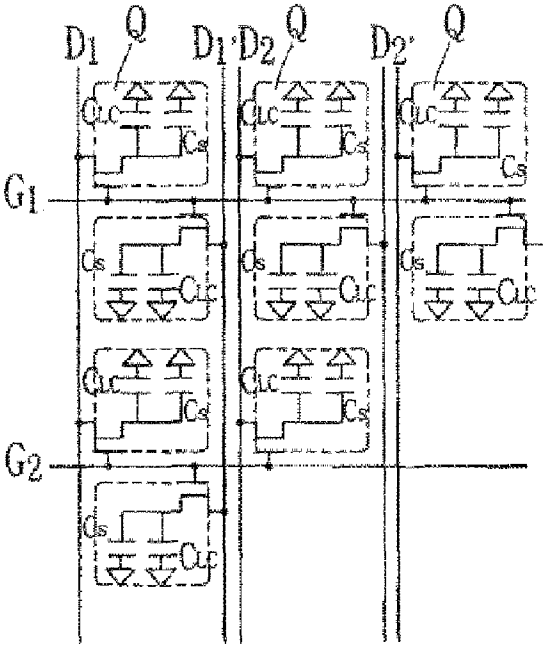
FIG. 11B is an enlarged schematic sectional view taken from FIG. 11A, which shows the arrangement of the gate lines and the data lines and the state of the gate and the source, which are connected to the gate lines and the data lines, of each thin film transistor.

Referring to FIG. 9A, the source drivers connected with the data lines are installed on the same side of the display panel. If the scanning frequency is 60 Hz and two gate lines are simultaneously turned on, the scanning time can be further reduced. The arrangement of the source drivers is shown as FIGS. 10A and 10B. The first and the second data lines of each group of data lines are respectively connected with the source drivers installed on the upper and the lower sides of the liquid crystal display, wherein the scanning frequency of the source drivers is kept at 60Hz. As shown in FIGS. 11A and 11B, the first data line and the second line of each group of data lines are connected with the same source driver, and the data transfer is switched by an electronic switch, of which scanning frequency is a multiple of 60 Hz, such as 120 Hz, 180 Hz . . . etc. The form of the gate driver can be a chip on glass or an integrated gate driver circuit on glass.

Figure 12:
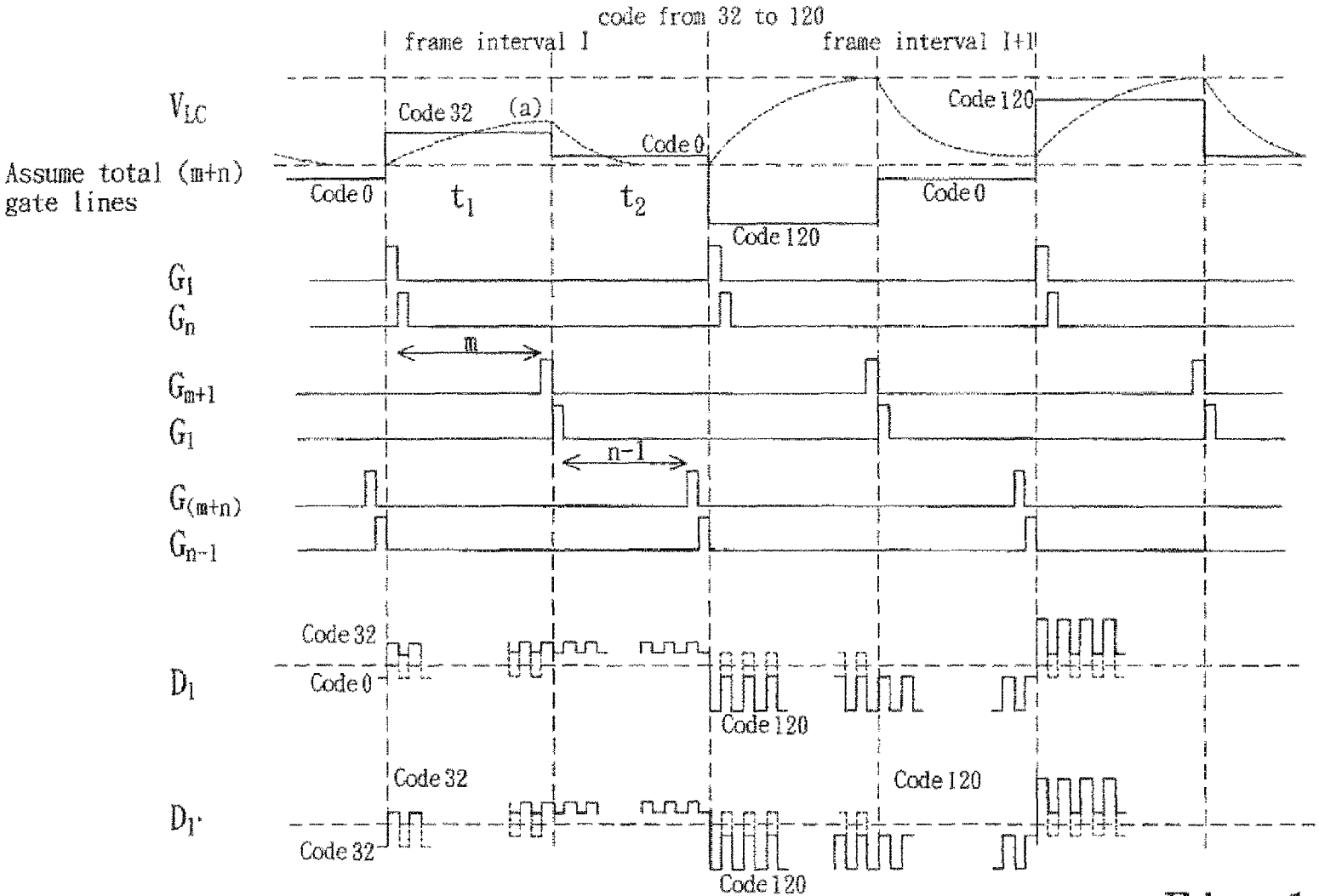
FIG. 12 is a wave form view of the signal used in the driving method of the display device of the second embodiment according to the present invention, which shows the variation of the wave form of the signal of the gate lines and the data lines from the gate driver and the source driver at different frame interval time.

Referring to FIG. 12, in the driving method of the present invention executed by the said device, when time enters the frame interval 1, the expected brightness is code 32 and $V_{LC}$ is the driving voltage pulse. To prevent the driving voltage pulse from confusing with the alternating voltage for driving liquid crystal, the value of the driving voltage pulse will be expressed with, code in the following statement. In FIG. 11, curve (a) represents the brightness variation of the pixel after being driven.

If there are m+n, i.e. N=m+n, gate lines in liquid crystal display, the period of the voltage of displaying the present frame data for the thin film transistor connected with the first gate line is set as the displaying brightness period $t_1$, and the period of the voltage of displaying black image received by the thin film transistor connected with the first gate line is set as the displaying black image period $t_2$.

When the displaying brightness period $t_1$ begins, the first and the $n^{th}$ gate lines $G_1$, $G_n$ are orderly turned on in a synchronous control time. The voltage of displaying the present frame data and the voltage of displaying black image are respectively given to the thin film transistors Q connected with the first and the $n^{th}$ gate lines. In the same manner, the second and the $n+1^{th}$ gate lines, the third and the $n+2^{th}$ gate lines . . . and the $m^{th}$ and the $m+n-1^{th}$ gate lines are turned on, and the voltage code 32 of displaying the present frame data is given to the thin film transistors Q connected with the second to $m^{th}$ gate lines, the voltage code 0 of displaying black image is given to the thin film transistors Q connected with the $n+1^{th}$ to $m+n-1^{th}$ gate lines.

When the displaying black, image period $t_2$ begins, the $m+1^{th}$ and the first gate lines $G_{m+1}$, $G_1$ are orderly turned on in a synchronous control time. The voltage code 32 of displaying the present frame data and the voltage code 0 of displaying black image are respectively given to the thin film transistors Q connected with the $m+1^{th}$ and the first gate lines $G_{m+1}$, $G_1$. The $m+2^{th}$ and the second gate lines, the $m+3^{th}$ and the third gate lines . . . and the $m+n^{th}$ (i.e. the last) and the $n-1^{th}$ gate lines $G_{m+n}$, $G_{n-1}$ are orderly and synchronously turned on. The voltage of displaying the present frame data is given to the thin film transistors Q connected with the $m+n^{th}$ to $m+n^{th}$ (i.e. the last) gate lines, and the voltage of displaying black image is given to the thin film transistors Q connected with the second to the $n-1^{th}$ gate lines.

If the ratio of the number of the gate lines scanned in the displaying brightness period $t_1$ to the number of the total gate lines is P and the period of the frame interval of the liquid crystal display is T, then the duration of the displaying brightness is PT and the duration of the keeping brightness is (1−P)T. The ratio P can be adjusted according the characteristic of the display panel.

When time enters the next frame interval I+1 and the expected brightness is code 120, the steps stated above can be repeated and the object of quickly changing the gray level of the liquid crystal display can be accomplished.

The Third Embodiment

Figure 13A:
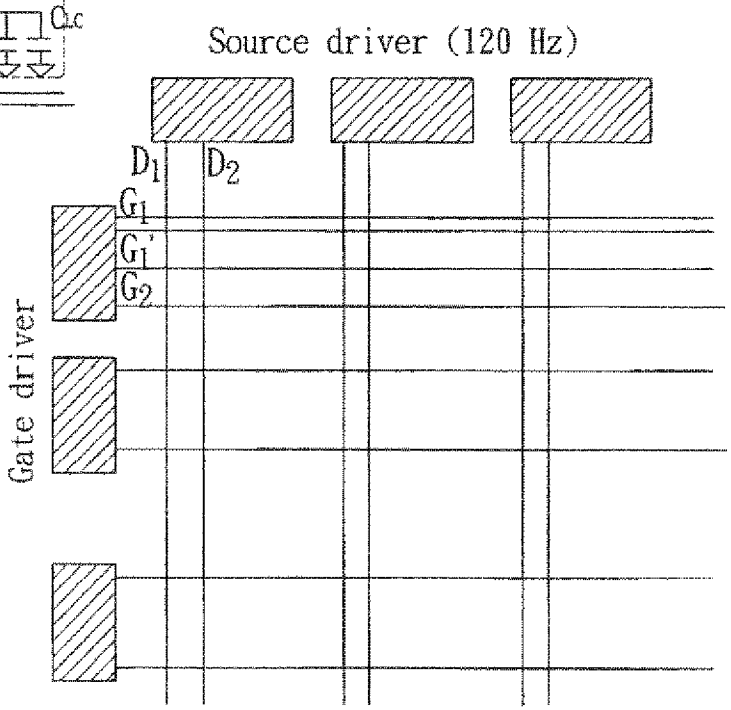
FIG. 13A is a schematic view showing the arrangement of the gate lines and the data lines of the display panel of the third embodiment according to the present invention.
Figure 13B:
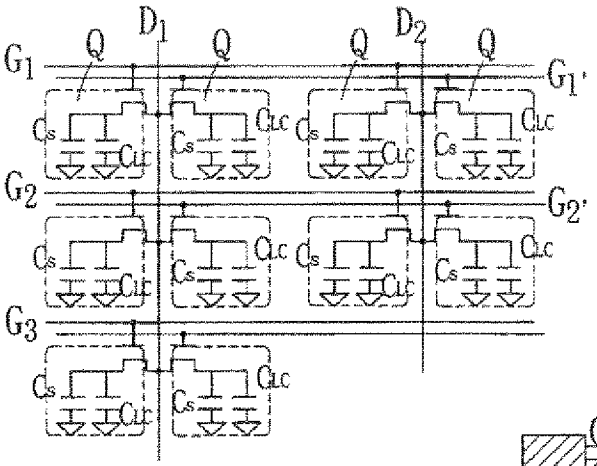
FIG. 13B is an enlarged schematic sectional view taken from FIG. 13A, which shows the arrangement of the gate lines and the data lines and the state of the gate and the source, which are connected to the gate lines and the data lines, of each thin film transistor.
Figure 13C:
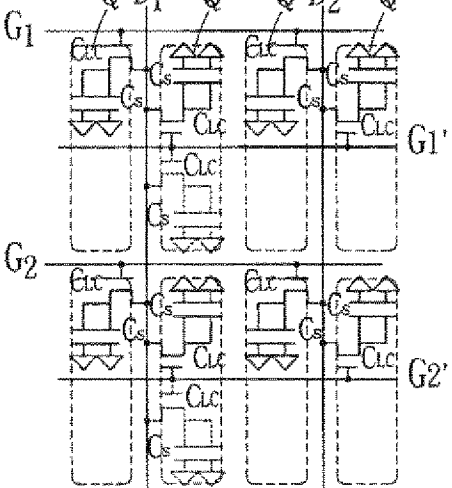
FIG. 13C is an enlarged schematic sectional view taken from FIG. 13A, which shows there is a space between the neighboring gate lines to prevent them from short circuit.

Referring to FIG. 13A to 13C, the third embodiment of the driving device for quickly changing the gray level of the liquid crystal display according to the present invention includes a group of thin film transistors with matrix array, which consists of N rows and 2M columns of thin film transistors Q, wherein each thin film transistor can drive one pixel, so there are in total N×2M of pixels (shown by the rectangle of dotted line). The first and the second gate lines $G_1$, $G_{1'}$ of the first group of the gate lines are respectively connected with the gates of all the thin, film transistors of the odd columns and the even columns of the first row, the first and the second gate lines $G_2$, $G_{2'}$ of the second group of gate lines are respectively connected with the gates of all the transistors Q of the odd columns and the even columns of the second row . . . and the first and the second gate lines of the $N^{th}$ group of gate lines are respectively connected with the gates of all the thin film transistors of the odd columns and the even columns of the $N^{th}$ row, therefore, there are in total N groups of gate lines connected to the gate drivers and insulated with, each other.

The first data line $D_1$ is connected with the sources of all the thin film transistors Q of the first and the second columns, the second data line $D_2$ is connected with, the sources of all the thin film transistors Q of the third and the fourth columns . . . and the $M^{th}$ data line is connected with the sources of all the thin film transistors Q of the $2M-1^{th}$ and the $2M^{th}$ columns. Therefore, there are in total M data lines connected with the source drivers and insulated with each other. To prevent the neighboring gate lines from short circuit, for example, the first and the second gate lines $G_1$, $G_{1'}$ of the first group of gate lines, there is a space between the neighboring gale lines, of which arrangement is shown as FIG. 13C. By the arrangement of the device stated above, the number of the data lines and the source drivers can be reduced.

Figure 14A:
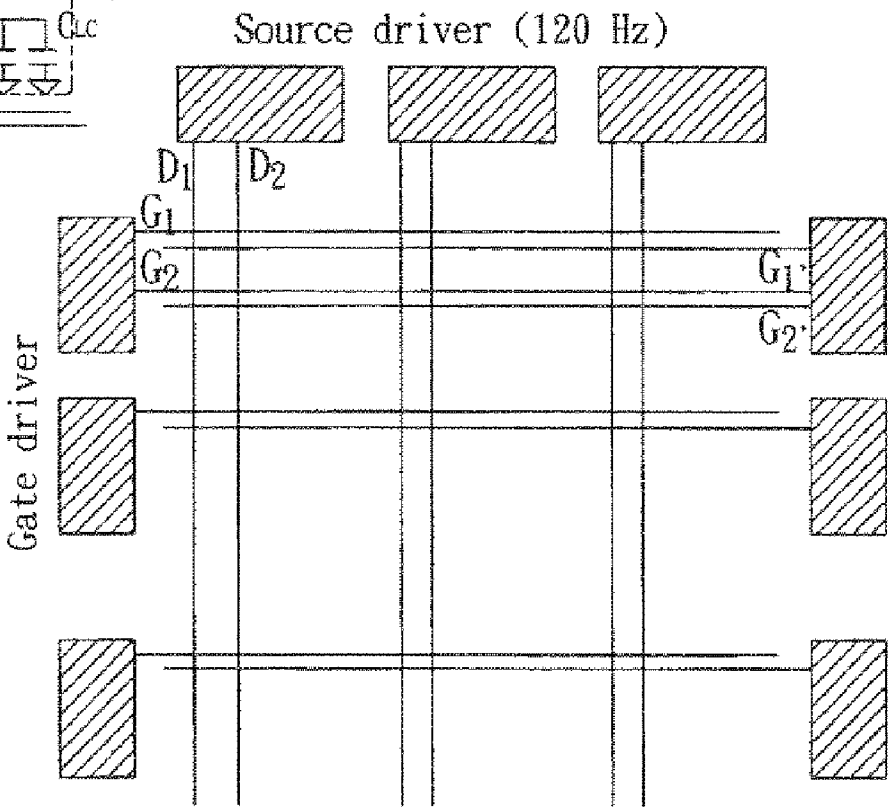
FIG. 14A is a schematic view of the arrangement of the gate lines and the data lines of the display panel of the third embodiment according to the present invention, which shows the state of the gate drivers respectively installed on the left side and the right side of the display panel.
Figure 14B:
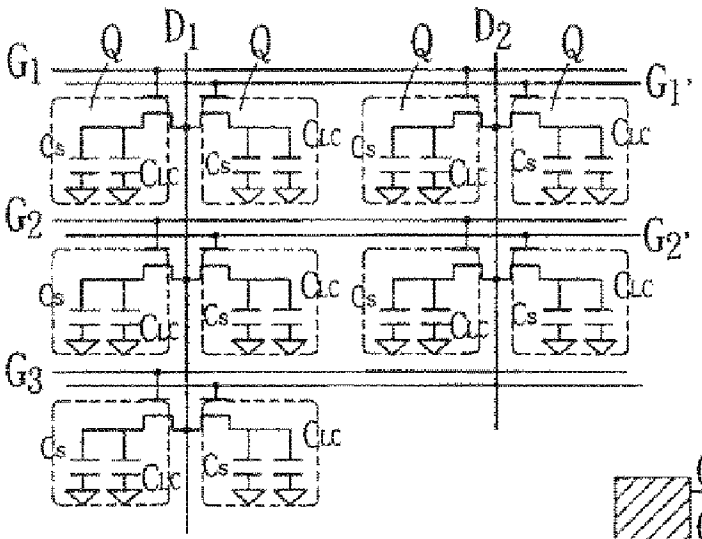
FIG. 14B is an enlarged schematic sectional view taken from FIG. 14A, which shows the arrangement of the gate lines and the data lines and the state of the gate and the source, which are connected to the gate lines and the data lines, of each thin film transistor.

Referring to FIG. 13A, the gate drivers connected with the gate lines are installed on the same side of the display panel. Referring to FIGS. 14A and 14B, the first and the second gate lines of each group of gate lines are respectively given data by two groups of gate drivers, and the two groups of gate drivers are respectively installed on the left side and the right side of the liquid crystal display. The form, of the gate driver can be a chip on glass, or an integrated gate driver circuit on glass.

Figure 15:
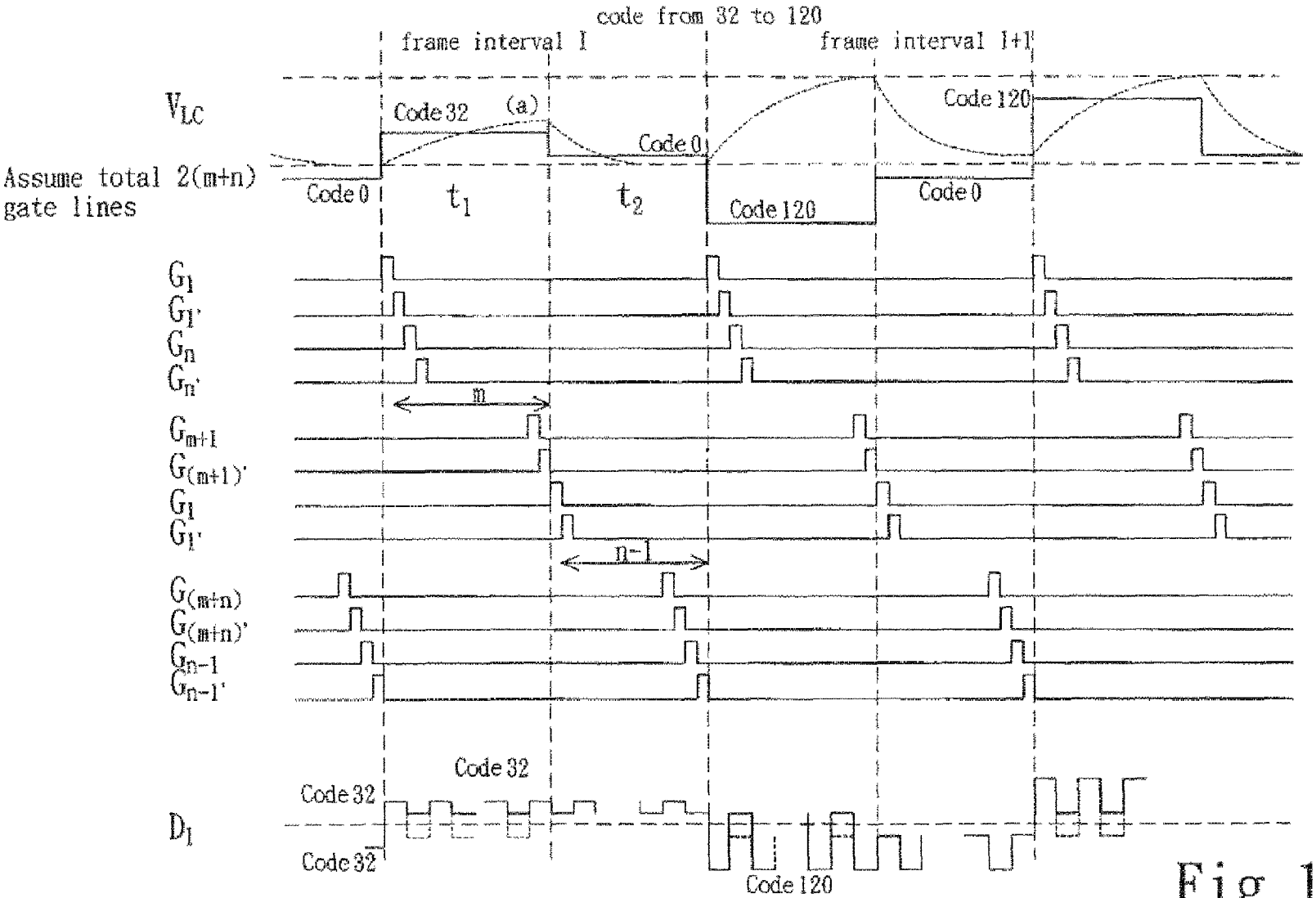
FIG. 15 is a wave form view of the signal used in the driving method of the display device of the third embodiment according to the present invention, which shows the variation of the wave form of the signal of the gate lines and the data lines from the gate drivers and the source drivers at different frame interval time.

Referring to FIG. 15, in the driving method of the present invention executed by the said device, when time enters the frame interval 1, the expected brightness is code 32 and $V_{LC}$ is the driving voltage pulse. To prevent the driving voltage pulse from confusing with the alternating voltage for driving liquid crystal, the value of the driving voltage pulse is expressed with code. In FIG. 15, curve (a) expresses the brightness variation of the pixel after being driven.

If there are 2(m+n), i.e. N=2(m+n), gate lines in the liquid crystal display, the period of the voltage of displaying the present frame data received by the thin film transistor connected with the first gate line of the first group of gate lines is set as the displaying brightness period $t_1$, and the period of the voltage displaying black, image received by the thin film transistor connected to the first gate line of the first group of gate lines is set as the displaying black image period $t_2$.

When time enters the displaying brightness period $t_1$, the first and the second gate line $G_1$, $G_{1'}$ of the first group of gate lines are orderly turned on in a time of one synchronous control signal. The voltage code 32 of displaying the present frame interval data is given to the thin film transistors Q connected with the first and the second gate lines of the first group of gate lines, and the first and the second gate lines $G_n$, $G_{n'}$ of the $n^{th}$ group of gate lines are orderly turned on by the synchronous control signal. The voltage code 0 of displaying black image is given to the thin film transistors Q connected with the first and the second gate lines $G_n$, $G_{n'}$ of the $n^{th}$ group of gate lines.

In the same manner, the first and the second gate lines of the second group of gate lines, the first and the second gate lines of the $n+1^{th}$ gate lines . . . the first and the second gate lines of the $m+n^{th}$ group of gate lines, the first and the second gate line $G_{m+1}$, $G_{m+1'}$ of the $m+1^{th}$ gate lines are orderly and synchronously turned on. The voltage code 32 of displaying the present frame interval data is given to the thin film transistors Q connected with the second to the $m+1^{th}$ groups of gate lines. The voltage code 0 of displaying black image is given to the thin film transistors Q connected with the $n+1^{th}$ to the $m+n^{th}$ group of gate lines.

When time enters the displaying black image period $t_2$, in a time of one synchronous control signal the first and the second gate lines of the first group of gate lines are orderly turned on. The voltage code 0 of displaying black image interval is given to the thin film transistors connected with the said gate lines. The first and the second gate lines of the $m+2^{th}$ group of gate lines are orderly turned on by the synchronous control signal. The voltage code 32 of displaying the present frame interval data is given to the thin film transistors Q connected with the said gate lines. The first and the second gate lines of the second group of gate lines, the first and the second gate lines of the $m+3^{th}$ group of gate lines . . . the first and the second (i.e. the last) of the $m+n^{th}$ group of gate lines and the first and the second gate lines of the $n-1^{th}$ gate lines are orderly and synchronously turned on. The voltage code 0 of displaying black image is given to the thin film transistors connected with the second to the $n-1^{th}$ gate lines. The voltage code 32 of displaying the present frame interval data is given to the thin film transistors Q connected with the $m+3^{th}$ to the $m+n^{th}$ gate lines.

If the ratio of the number of the gate lines scanned in the displaying brightness period $t_1$ to the number of the total gate lines is P and the period of the frame interval of the liquid crystal display is T, then the displaying brightness duration is PT and the keeping brightness duration is (1−P)T. The ratio P can be adjusted according to the characteristic of the display panel.

When time enters the next frame interval I+1 and the expected brightness is code 120, the steps stated above can be repeated and the object of quickly changing the gray level of the liquid, crystal display can be accomplished.

The Fourth Embodiment

Figure 16A:
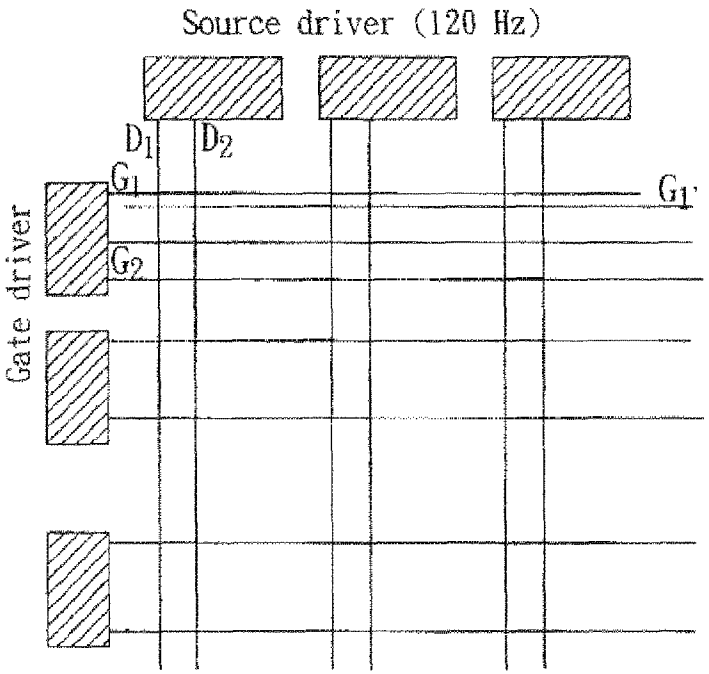
FIG. 16A is a schematic view showing the arrangement of the gate lines and the data lines of the display panel of the fourth embodiment according to the present invention.
Figure 16B:
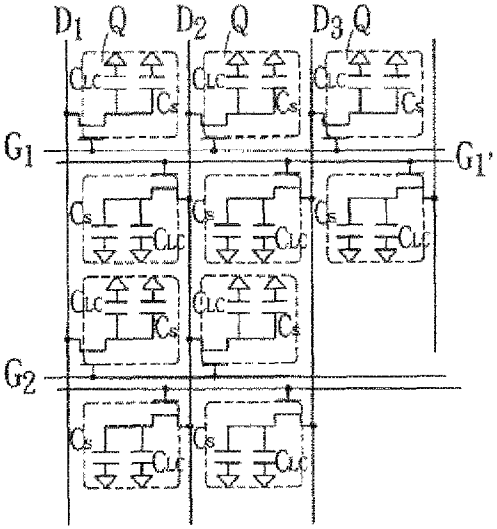
FIG. 16B is an enlarged schematic sectional view taken from FIG. 16A, which shows the arrangement of the gate lines and the data lines and the state of the gate and the source, which are connected to the gate lines and the data lines, of each thin film transistor.

Referring to FIGS. 16A and 16B, the fourth embodiment of the driving device for quickly changing the gray level of the liquid crystal display according to the present invention includes a group of thin film transistors Q with matrix array, which consists of N rows and M columns of thin film transistors Q, wherein each thin film transistor Q can drive one pixel, so total 2N×M of pixels (shown by the rectangle with dotted line) can be driven. The first gate line $G_1$ of the first group of gate lines is connected, with the gates of all the thin film transistors Q of the first row, the second gate line $G_{1'}$ of the first group of gate lines is connected with the gates of all the thin film transistors Q of the second row . . . and the second gate line of the $N^{th}$ group of gate lines is connected with the gates of all the thin film transistors Q of the $2N^{th}$ row, therefore, there are in total N groups of gate lines connected to gate drivers and insulated with each other.

The first and the second data lines $D_1$, $D_2$ are respectively connected with the sources of all the thin film transistors Q of the odd and the even rows of the first column, the second and the third, data lines $D_3$, $D_4$ are respectively connected with the sources of all the thin film transistors Q of the odd and the even rows of the second column . . . and the $M^{th}$ and the $M+1^{th}$ data lines are respectively connected with the sources of all the thin film transistors Q of the odd and the even rows of the $M^{th}$ column, therefore there are in total M+1 data lines connected to the source drivers and insulated with each other.

Figure 16C:
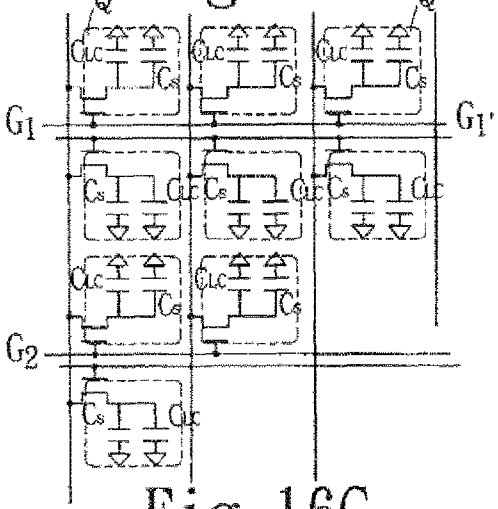
FIG. 16C is an enlarged schematic sectional view taken from FIG. 16A, which shows another arrangement of the gate lines and the data lines of the display panel of the fourth embodiment according to the present invention.

Referring to FIG. 16C, which is the other form of the fourth embodiment. It also consists of 2N rows and M columns of thin film transistors Q, wherein each thin film transistor Q can drive one pixel, so total 2N×M of pixels (shown by rectangle with dotted line) can be driven. The first gate line $G_1$ of the first group of gate lines is connected with the gates of all the thin film transistors Q of the first row, the second gate line $G_2$ of the first group of gate lines is connected with the gates of all the thin film transistors Q of the second row . . . and the second gate line of the $N^{th}$ gate lines is connected with the gates of all the thin film transistors of the $N^{th}$ row, therefore, there are in total N groups of gate lines connected to the gate drivers and insulated with each other. The first data line $D_1$ is connected with the sources of all the thin film, transistors Q of the first column, the second data line $D_2$ is connected with the sources of all the thin film transistors Q of the second column . . . and the $M^{th}$ data line is connected with the sources of all the thin film transistors Q of the $M^{th}$ column, therefore, there are in total M data lines connected to the source drivers and insulated with each other.

Figure 17A:
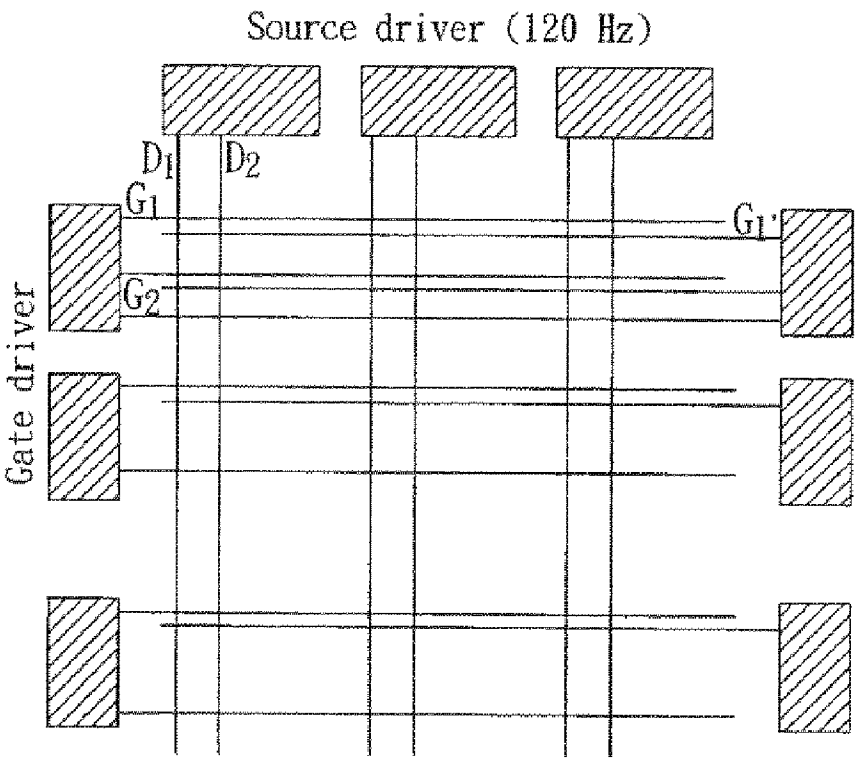
FIG. 17A is a schematic view of the arrangement of the gate lines and the data lines of the display panel of the fourth embodiment according to the present invention, which shows the state of the gate drivers respectively installed on the left side and the right side of the display panel.
Figure 17B:
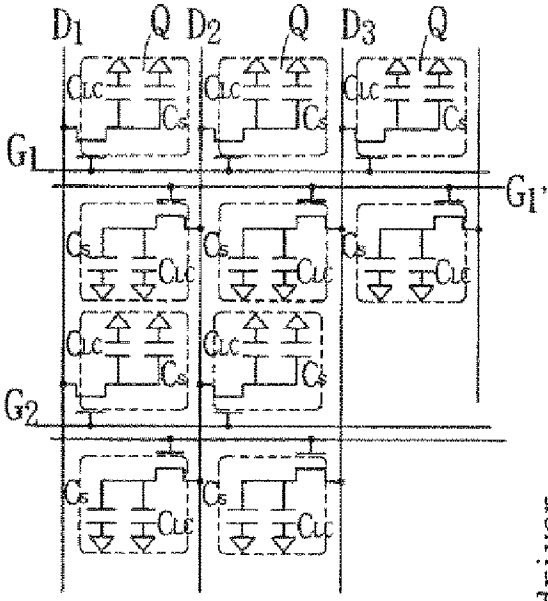
FIG. 17B is an enlarged schematic sectional view taken from FIG. 17A which shows the arrangement of the gate lines and the data lines and the state of the gate and the source, which are connected to the gate lines and the data lines, of each thin film transistor.

Referring to FIG. 16A, the gate drivers connected with the gate lines are installed on the same side of the display panel. Referring to FIG. 17, t the first gate line and the second gate line of each group of gate lines are respectively given data by two groups of gate drivers, and the said two groups of gate drivers are respectively installed on the left and the right sides of the liquid crystal display. The form of the gate driver can be a chip on glass, or an integrated gate driver circuit on glass.

Figure 18:
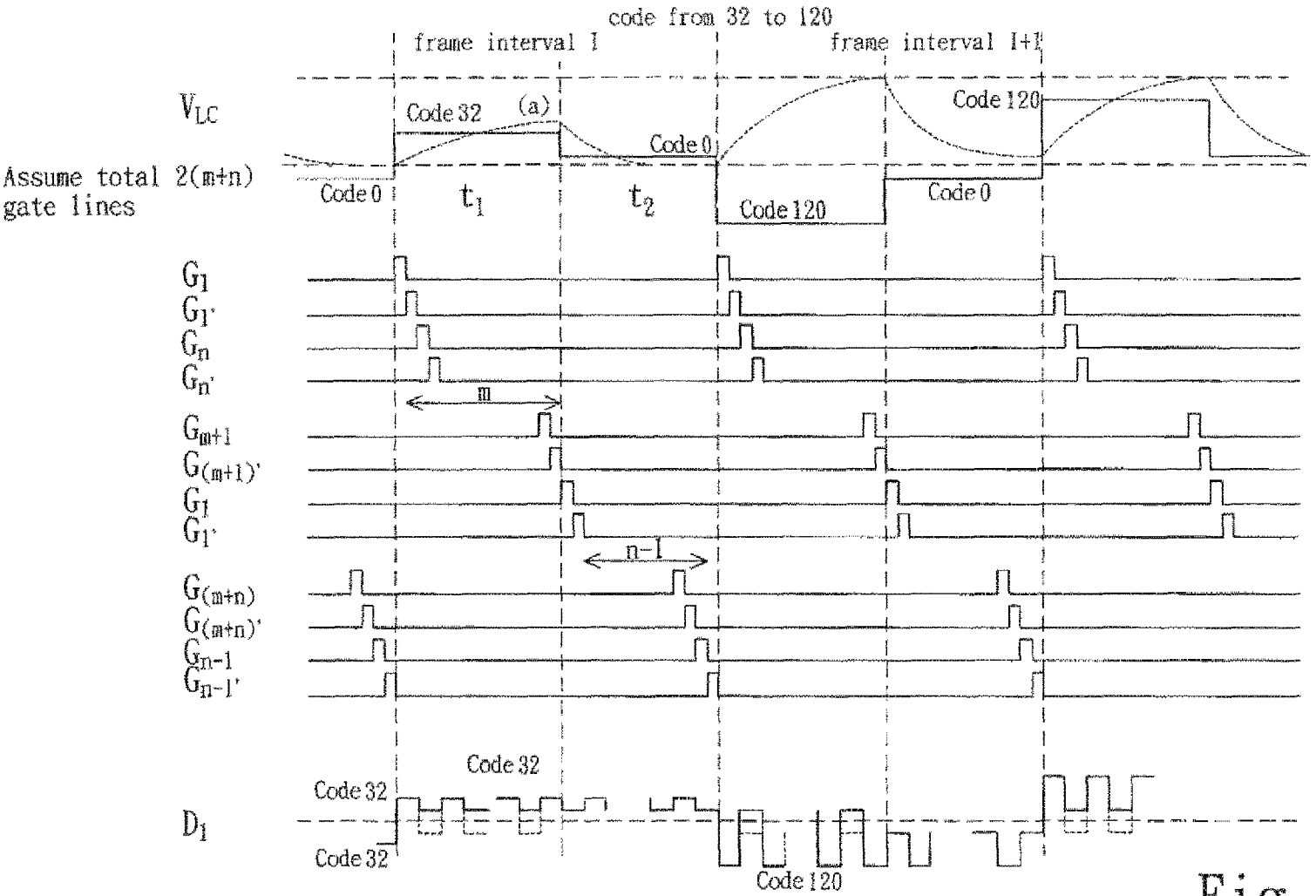
FIG. 18 is a wave form view of the signal used in the driving method of the display device of the fourth embodiment according to the present invention, which shows the variation of the wave form of the signal of the gate lines and the data lines from the gate drivers and the source drivers at different frame interval time.

There are two methods to execute the two forms of the embodiments stated above. Referring to FIG. 18, in the first driving method, when time enters the frame interval 1, the expected brightness is code 32 and the $V_{LC}$ is the driving voltage pulse. To prevent the driving voltage from confusing with the alternating voltage for driving liquid crystal, the value of the driving voltage is expressed with code in the following statement. In FIG. 18, curve (a) expresses the brightness variation of the pixel, after being driven.

If there are 2(m+n), i.e. N=2(m+n), gate lines in liquid crystal display, the period of the voltage of displaying the present frame interval data received by the thin film transistors connected with the first gate line of the first group of gate lines is set as the displaying brightness period $t_1$, and the period of voltage of displaying black image received by the thin film transistors connected with the first gate line of the first groups of gate lines is set as the displaying black image period $t_2$.

When time enters the displaying brightness period $t_1$, the first and the second gate lines $G_1$, $G_{1'}$ of the first group of gate lines are orderly turned on in a time of one synchronous control signal. The voltage code 32 of displaying the present frame interval data is given to the thin film transistors Q connected with the first and the second gate lines $G_1$, $G_{1'}$ of the first group of gate lines. The first and the second gate lines $G_n$, $G_{n'}$ of the $n^{th}$ group of gate lines are orderly turned on by the synchronous control signal. The voltage code 0 of displaying black image is given to the thin film transistor Q connected with the said gate lines. The first and the second gate lines of the second group of gate lines, the first and the second gate lines of the $n+1^{th}$ group of gate lines . . . the first and the second gate lines of the $m+n-1^{th}$ group of gate lines and the first and the second gate lines $G_{m+1}$, $G_{m+1'}$ of the $m+1^{th}$ group of gate lines are orderly and simultaneously turned on in a time of synchronous control signal. The voltage code 32 of displaying the present frame interval data is given to the thin film transistors Q connected with the second to the $m+1^{th}$ groups of gate lines. The voltage code 0 of displaying black image is given to the thin film transistors Q connected with the $n+1^{th}$ to the $m+n-1^{th}$ groups of gate lines.

When the time enters the black image period $t_2$, the first and the second gate lines $G_1$, $G_{1'}$ of the first group of gate lines are orderly turned on in a time of one synchronous, control signal. The voltage code 0 of displaying black image is given to the thin film transistors connected with the said gate lines. The first and the second gate lines of the $m+2^{th}$ group of gate lines are orderly turned on by the synchronous control signal. The voltage code 32 of displaying the present frame interval data is given to the thin film transistors connected with the said gate lines. The first and the second gate lines of the second group of gate lines, the first and the second gate lines of the $m+3^{th}$ group of gate lines . . . the first and the second gate lines $G_{m+n}$, $G_{m+n'}$ of the $m+n^{th}$ group of gate lines and the first and the second gate lines $G_{n-1}$, $G_{n-1'}$ of the $n-1^{th}$ group of gate lines are orderly and synchronously turned on. The voltage code 32 of displaying the present frame interval data is given to the thin film transistors Q connected with the $m+3^{th}$ to the last gate lines. The voltage code 0 of displaying black image is given to the transistors Q connected with the second to the $n-1^{th}$ group of gate lines. By use of the steps stated above, the gray level of the liquid crystal display can be quickly changed.

Figure 19:
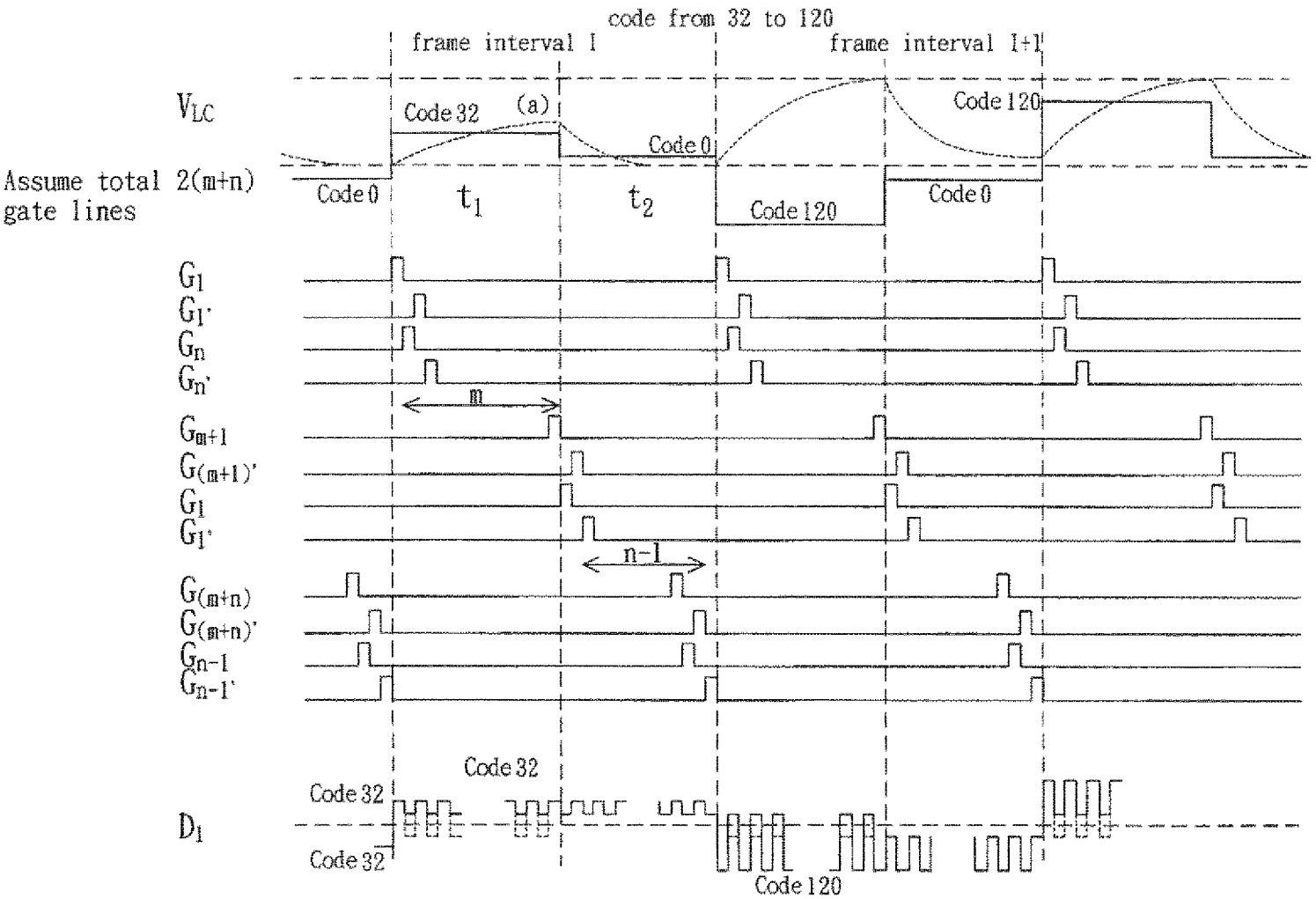
FIG. 19 is a wave form view of the signal used in another driving method of the display device of the fourth embodiment according to the present invention, which shows the variation of the wave form of the signal of the gate lines and the data lines from the gate drivers and the source drivers at different frame interval time.

Referring to FIG. 19, it shows the second driving method of the present invention. When time enters the frame interval 1, the expected brightness is code 32 and $V_{LC}$ is the driving voltage pulse. The voltage value is expressed with code in the following statement to prevent the driving voltage from confusing with the alternating voltage for driving the liquid crystal. In FIG. 19, curve (a) expresses the brightness variation of the pixel after being driven.

If there are 2m+2n, i.e. N=2m+2n, gate lines in the liquid crystal display, the period of the voltage of displaying the present frame interval data received by the thin film transistors connected with the first gate line of the first group of gate lines is set as the displaying brightness period $t_1$, and the period of the voltage of displaying black image received by the thin film transistors connected with the first gate line of the first group of gate lines is set as the displaying black image period $t_2$.

When time enters the display brightness period $t_1$, the first gate line $G_1$ of the first group of gate lines and the first gate line $G_n$ of the $n^{th}$ group of gate lines are orderly turned on in a time of one synchronous control signal. The voltage code 32 of displaying the present frame interval data and the voltage code 0 of displaying black image are respectively given to the thin film transistors Q connected with the said gate lines. Then the second gate line $G_{1'}$ of the first group of gate lines and the second gate line $G_{n'}$ of the $n^{th}$ group of gate lines, the first gate line of the second group of gate lines and the first gate line of the n+1 th group of gate lines . . . and the second gate line of the m+n−1 th group of gate lines and the second gate line of the m+1 th group of gate lines are orderly and synchronously turned on by the synchronous control signal The voltage code 32 of displaying the present frame interval data is given to the thin film transistors Q connected with the first to the $m^{th}$ groups of gate lines. The voltage code 0 of displaying black image is given to the thin film transistors Q connected with the n+1 th to the m+n−1 th groups of gate lines.

When time enters the displaying black image period $t_2$, the first gate line $G_1$ of the first group of gate lines and the first gate line of the $m+2^{th}$ group of gate lines are orderly turned on in a time of one synchronous control signal. The voltage code 0 of displaying black image and the voltage code 32 of displaying the present frame interval data are respectively given to the thin film transistors Q connected with the said gate lines. The second gate line $G_{1'}$ of the first group of gate lines and the second gate line of the $m+2^{th}$ group of gate lines, the first gate line of the second group of gate lines and the first gate line of the $m+3^{th}$ group of gate lines . . . and the second gate line $G_{(n-1\gamma}$ of the $n-1^{th}$ group of gate lines and the second (i.e. the last) gate line $G_{(m+n)'}$ of the $m+n^{th}$ group of gate lines are orderly and synchronously turned on. The voltage code 32 of displaying the present frame interval data is given, to the thin film transistors Q connected with the $m+1^{th}$ group to the last gate line $G_{(m+m)'}$. The voltage code 0 of displaying black image is given to the thin film transistors Q connected with the second group of gate lines to the $n-1^{th}$ group of gate lines.

If the ratio of the number of the gate lines scanned in the displaying brightness period $t_1$ to the number of the total gate lines is P and the period of the frame interval of the liquid crystal display is T, then the displaying brightness duration is PT and the keeping brightness duration is (1−P)T. The ratio P can be adjusted according to the characteristic of the display panel.

When time enters the next frame interval I+1 and the expected brightness is code 120, the steps stated above can be repeated and the object of quickly changing the gray level of the liquid crystal display can be accomplished.

The Fifth Embodiment

Figure 20A:
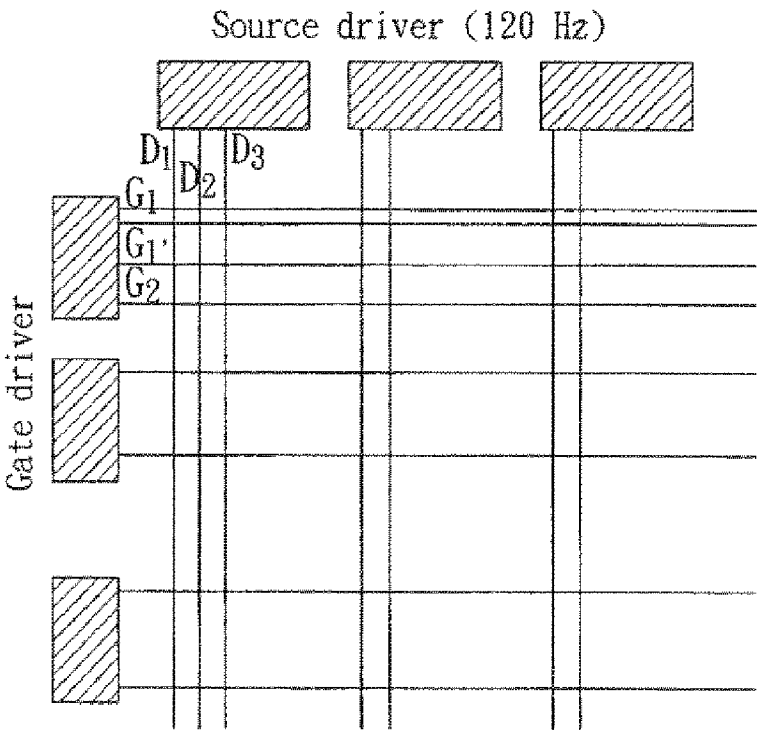
FIG. 20A is a schematic view showing the arrangement of the gate lines and the data lines of the display panel of the fifth embodiment according to the present invention.
Figure 20B:
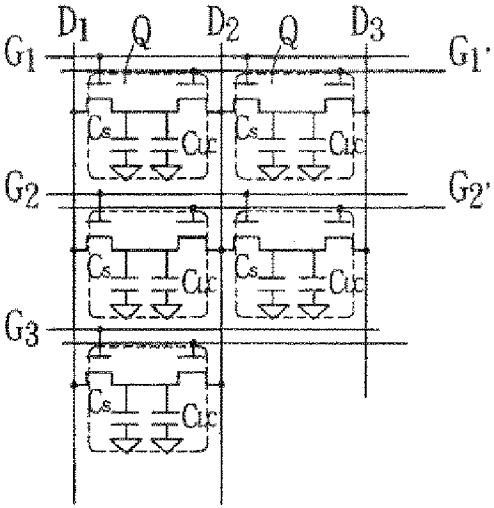
FIG. 20B is an enlarged schematic sectional view taken from FIG. 20A which shows the arrangement of the gate lines and the data lines and the state of the gate and the source, which are connected to the gate lines and the data lines, of each thin film transistor.
Figure 20C:
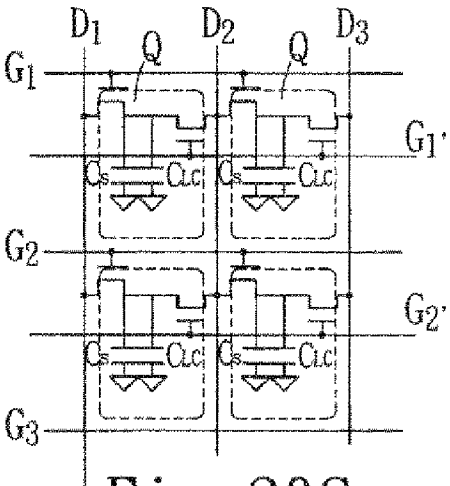
FIG. 20C is an enlarged schematic sectional view taken from FIG. 20A, which shows there is a space between the neighboring gate lines to prevent them from short circuit.

Referring to FIG. 20A to 20C, the fifth embodiment of the driving device for quickly changing the gray level of the liquid crystal display according to the present invention includes a group of thin film transistors Q with matrix array, which consists of N rows and 2M columns of thin film transistors Q. One pixel is driven by two neighboring thin film transistors Q, therefore total. N×M of pixels (shown by rectangle with dotted line) can be driven. The first and the second gate lines $G_1$, $G_{1'}$ of the first group of gate lines are respectively connected with the gates of all the thin film transistors Q of the odd and the even columns of the first row. The first and the second gate lines $G_2$, $G_{2'}$ of the second group of gate lines are respectively connected with the gates of all the thin film transistors Q of the odd and the even columns of the second row . . . and the first and the second gate lines of the $N^{th}$ group of gate lines are respectively connected with the gates of all the thin film transistors Q of the odd and the even columns of the $N^{th}$ row. Therefore, there are in total N groups of gate lines connected to the gate drivers and insulated with each other.

The first, data line $D_1$ is connected with the sources of all the thin film transistors Q of the first column. The second data line $D_2$ is connected with the sources of all the thin film transistors Q of the second column . . . and the $2M^{th}$ data line is connected with the sources of all the thin film transistors Q of the $2M^{th}$ column. Therefore, there are in total 2M data lines connected to the source drivers and insulated with each other. To prevent the neighboring gate lines from short circuit, for example, the first gate line $G_1$ and the second gate line $G_{1'}$ of the first group of gate lines, there is a space between the two neighboring gate lines, of which arrangement is shown as FIG. 20C.

Figure 21A:
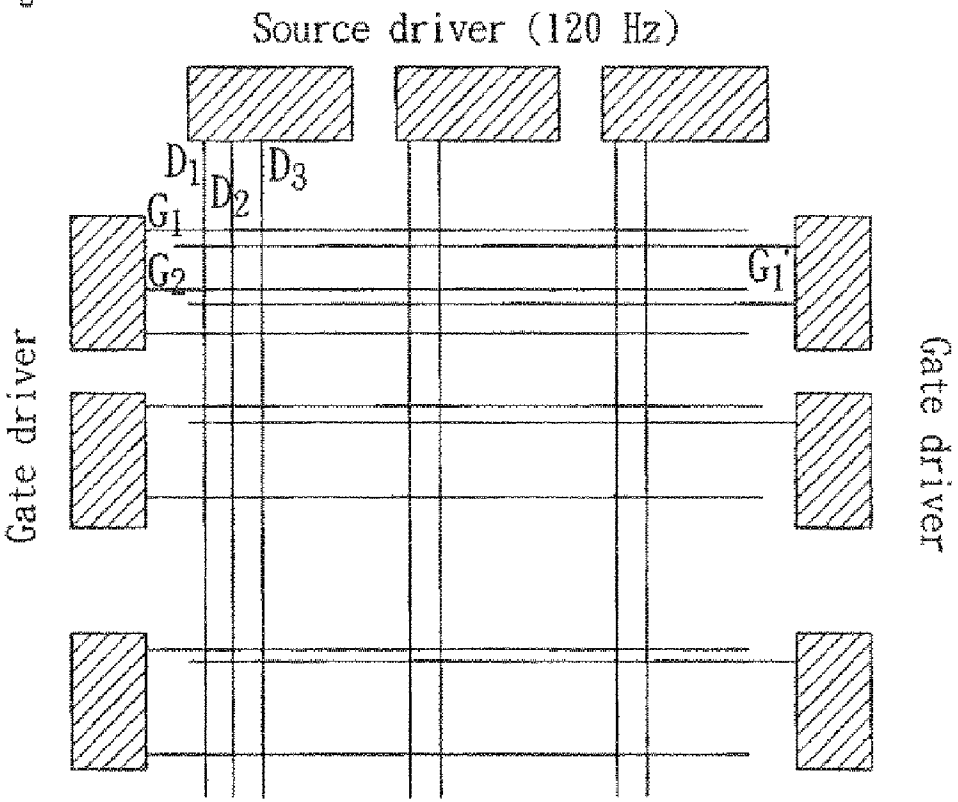
FIG. 21A is a schematic view of the arrangement of the gate lines and the data lines of the display panel of the fifth embodiment according to the present invention, which shows the state of the gate drivers respectively installed on the left side and the right side of the display panel.
Figure 21B:
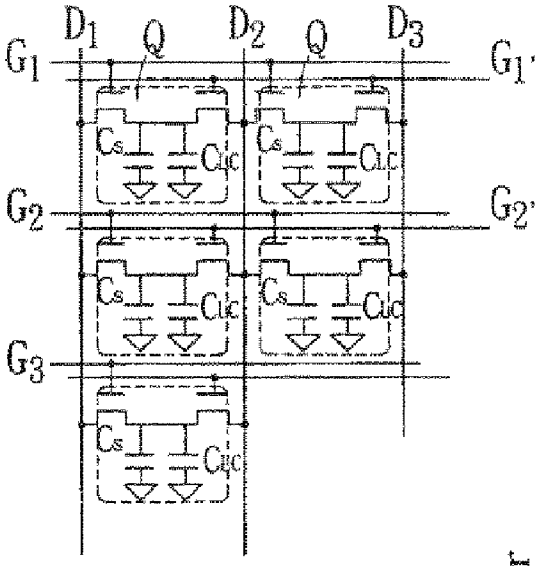
FIG. 21B is an enlarged schematic sectional view taken from FIG. 21A, which shows the arrangement of the gate lines and the data lines and the state of the gate and the source, which are connected to the gate lines and the data lines, of each thin film transistor.

Referring to FIG. 20A, the gate drivers connected with the gate lines are installed on the same side of the display panel. Referring to FIGS. 21A and 21B, the first gate line and the second gate line of each group of gate lines are respectively given data by two groups of gate drivers, and the said two groups of gate drivers are respectively installed on the left and the right sides of the liquid crystal display. The form of the gate driver can be a chip on glass or an integrated gate driver circuit on glass.

Figure 22:
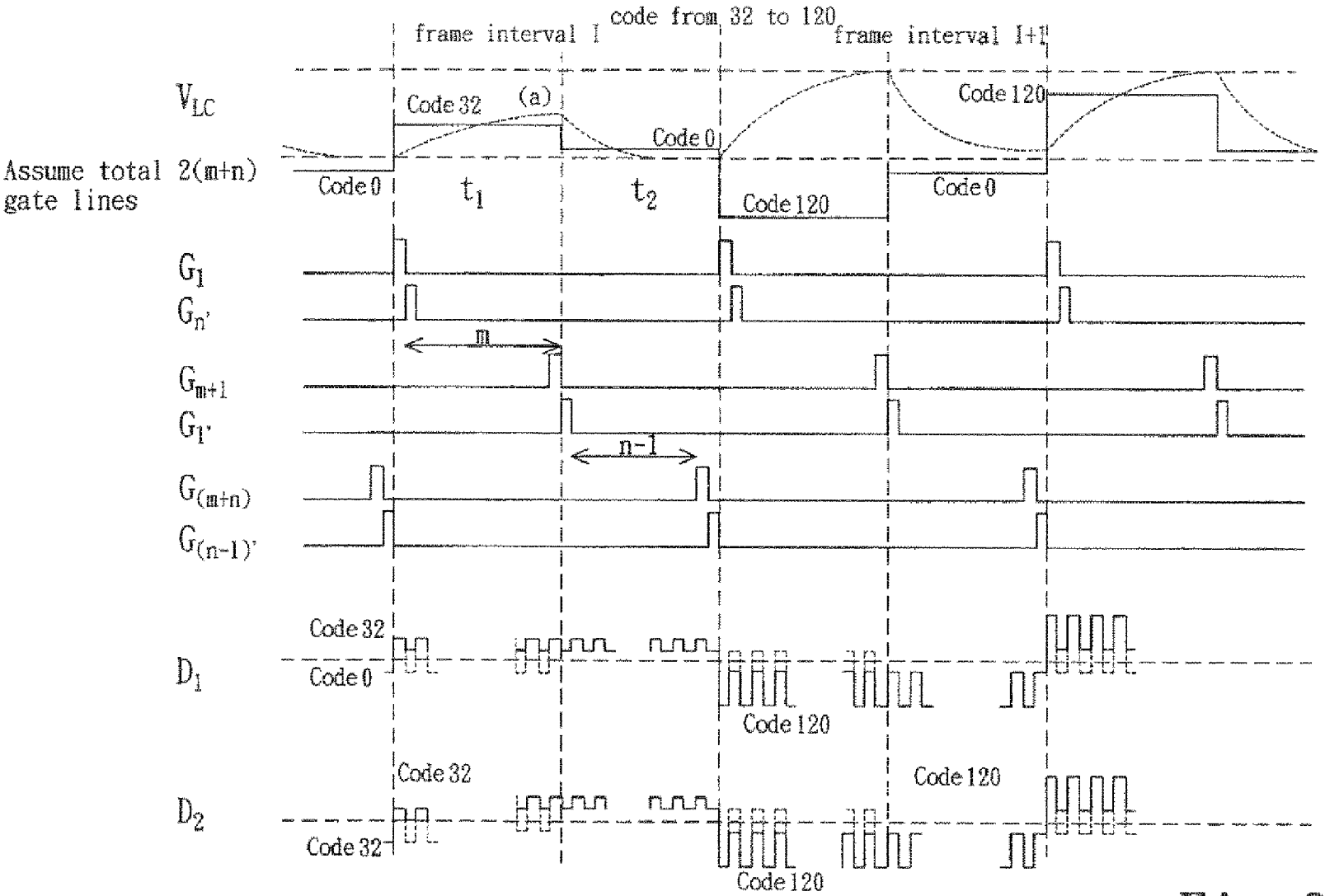
FIG. 22 is a wave form view of the signal used in the driving method of the display device of the fifth embodiment according to the present invention, which shows the variation of the wave form of the signal of the gate lines and the data lines from the gate drivers and the source drivers at different frame interval time.

Referring to FIG. 22, the driving method of the present invention can be executed by the device stated above. When time enters the frame interval 1, the expected brightness is code 32 and $V_{LC}$ is the driving voltage pulse. The value of the driving voltage pulse is expressed with code in the following statement to prevent the driving voltage from confusing the alternating voltage for driving liquid crystal. In FIG. 22 curve (a) expresses the brightness variation of the pixel after being driven.

If there are 2m+2n, i.e. N=2m+2n, gate lines in the liquid crystal display, the period of the voltage of displaying the present frame interval data received by the thin film transistors connected with the first gate line of the first group of gate lines is set as the displaying brightness period $t_1$, and the period of the voltage of displaying black image received by the thin film transistors connected with the second gate line of the first group of gate lines is set as the displaying black image period $t_2$.

When time enters the displaying brightness period $t_1$, the first gate line $G_1$ of the first group of gate lines and the second gate line $G_{n'}$ of the $n^{th}$ group of gate lines are orderly turned on in a time of one synchronous control signal. The voltage code 32 of displaying the present frame interval data and the voltage code 0 of displaying black image are respectively given to the thin film transistors Q connected with the said gate lines. The first gate line of the second group of gate lines and the second gate line of the $n+1^{th}$ group of gate lines, the first gate line of the third group of gate lines and the second gate line of the $n+2^{th}$ group of gate lines . . . and the second gate line of the $m+n-1^{th}$ group of gate lines and the first gate line of the $m+1^{th}$ group of gate lines are orderly and synchronously turned on in the time of synchronous control signal. The voltage code 32 of displaying the present frame interval data is given to the thin film transistors Q connected with the first gate line of the second group to the $m+1^{th}$ group of gate lines. The voltage code 0 of displaying black image is given to the thin film transistors Q connected with the second gate line of the $n+1^{th}$ group to the $m+n-1^{th}$ group of gate lines.

When time enters the displaying black image period $t_2$, the second gate line $G_{1'}$ of the first group of gate lines and the first gate line of the $m+2^{th}$ group of gate lines are orderly turned on in a time of one synchronous control signal. The voltage code 0 of displaying black image and the voltage code 32 of displaying the present frame interval data are respectively given to the thin film transistors Q connected with the said gate lines. The first gate line of the $m+3^{th}$ group of gate lines and the second gate line of the second group of gate lines, the first gate line of the $m+4^{th}$ group of gate lines and the second gate line of the third group of gate lines . . . and the first gate line of the $m+n^{th}$ group of gate lines and the second gate line of the $n-1^{th}$ group of gate lines are orderly and synchronously turned on. The voltage code 0 of displaying black image is given to the thin film transistors Q connected with the second gate line of the second group to the $n-1^{th}$ group of gate lines. The voltage code 32 of displaying the present frame interval data is given to the thin film transistors Q connected with the first gate lines of the $m+3^{th}$ group to the $m+n^{th}$ group of gate lines.

If the ratio of the number of the gate lines scanned in the displaying brightness period $t_1$ to the number of the total gate lines is P and the frame interval period of the liquid crystal display is T, then the displaying brightness duration is PT and the keeping brightness duration is (1−P)T. The ratio P can be adjusted according to the characteristic of the display panel.

When time enters the next frame interval I+1 and the expected brightness is code 120, the steps stated above can be repeated and the object of quickly changing the gray level of the liquid crystal display can be accomplished.

The Sixth Embodiment

Figure 23A:
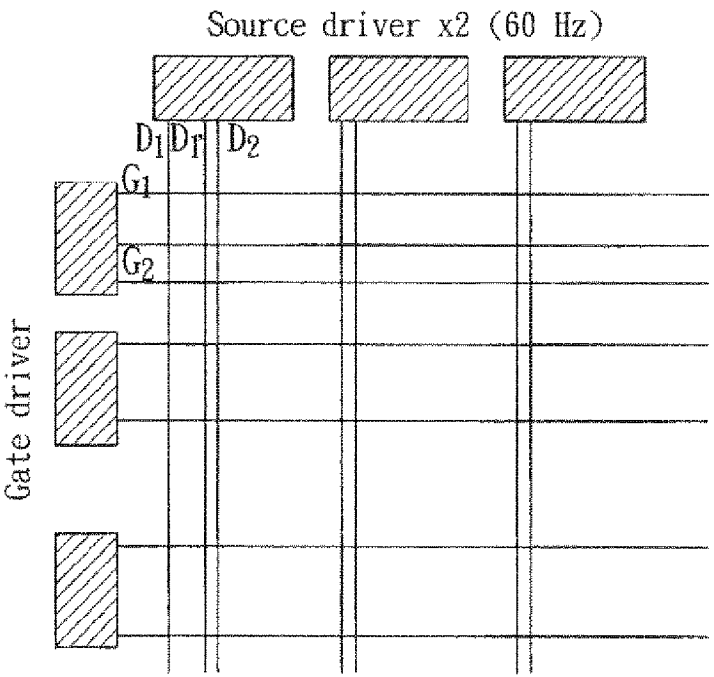
FIG. 23A is a schematic view showing the arrangement of the gate lines and the data lines of the display panel of the sixth embodiment according to the present invention.
Figure 23B:
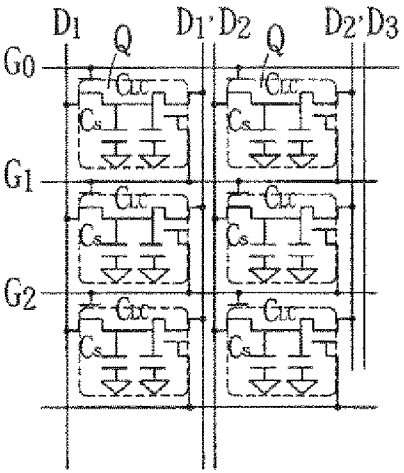
FIG. 23B is an enlarged schematic sectional view taken from FIG. 22A, which shows the arrangement of the gate lines and the data lines and the state of the gate and the source, which are connected to the gate lines and the data lines, of each thin film transistor.
Figure 23C:
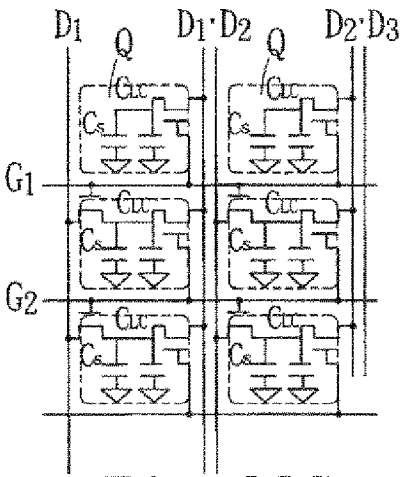
FIG. 23C is an enlarged schematic sectional view taken from FIG. 22A, which shows another arrangement of the gate lines and the data lines and the state of the gate and the source, which are connected to the gate lines and the data lines, of each thin film transistor.

Referring to FIG. 23A to 23C, the sixth embodiment of the driving device for quickly changing the gray level of the liquid crystal display according to the present invention includes a group of thin film transistors Q with matrix array, which consists of N rows and 2M columns of thin film transistors Q. One pixel is driven by two neighboring thin film transistors so that total N×M of pixels (shown by the rectangle with dotted line) can be driven. The first and the second gate lines $G_1$, $G_2$ are respectively connected with the gates of all the thin film transistors Q of the odd column and the even column of the first row. The second and the third, gate lines $G_2$, $G_3$ are respectively connected with gates of all the thin film transistors Q of the odd column and the even column of the second row . . . and the $N^{th}$ and the $N+1^{th}$ gate lines are respectively connected with, the gates of all the thin film transistors Q of the odd column and the even column of the $N^{th}$ row. Therefore, there are in total N gate lines connected to the gate drivers and insulated with each other.

The first data line $D_1$ of the first group of data lines is connected with the sources of all the thin film transistors Q of the first column. The second data line $D_{1'}$ of the first group of data lines is connected with the sources of all the thin film transistors Q of the second column . . . and the second data line of the $M^{th}$ group of data lines is connected with the sources of all the thin film transistors Q of the $2M^{th}$ column. Therefore, there are in total M groups of data lines connected to the source drivers and insulated with each other.

Figure 23D:
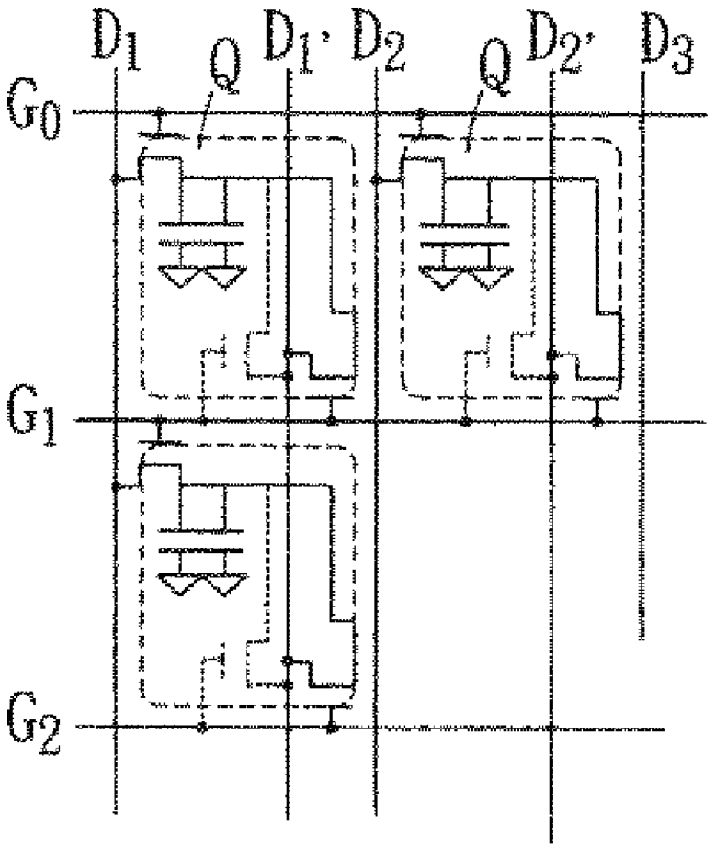
FIG. 23D is an enlarged schematic sectional view taken from FIG. 23A, which shows there is a space between the neighboring data lines for preventing them from short circuit.

Referring to FIG. 23C, a row of thin film transistors Q can be additionally installed above the first row of thin film transistors Q in the present embodiment. Each thin film transistor Q can control a pixel The gates of the said row of thin film transistors Q are connected with the first gate line and their sources are connected with the second data line of each group of data lines. To prevent the neighboring data lines from short circuit, for example, the second data line $D_{1'}$ of the first group of data lines and the first data line $D_2$ of the second group of data lines, there is a space between two neighboring data lines of which arrangement is shown as FIG. 23D.

Figure 24A:
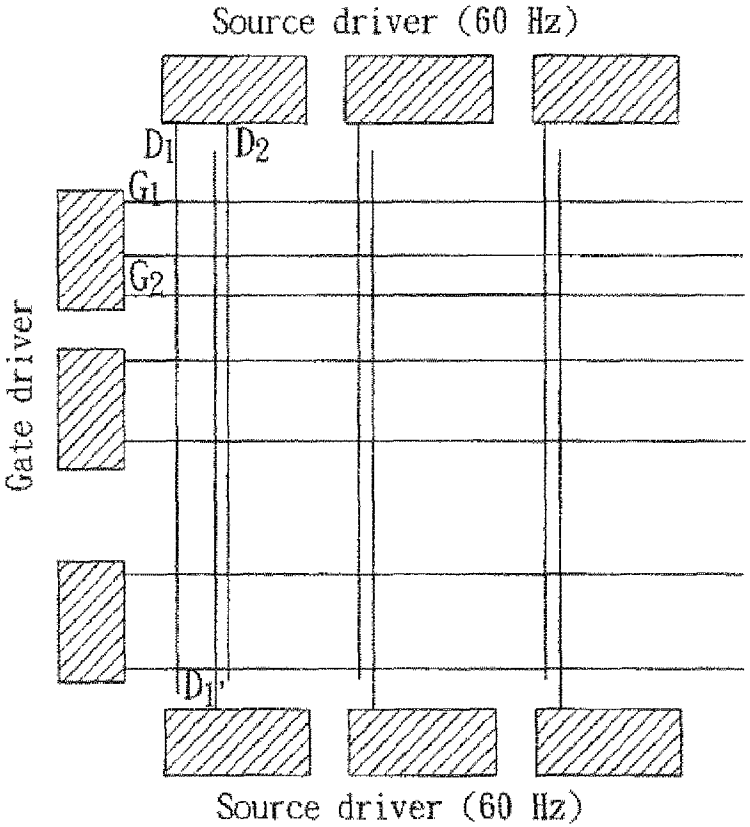
FIG. 24A is a schematic view of the arrangement of the gate lines and the data lines of the display panel of the sixth embodiment according to the present invention, which shows the state of the source drivers respectively installed on the upper side and the lower side of the display panel.
Figure 24B:
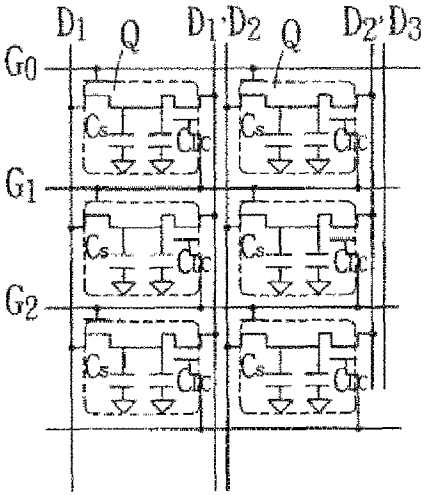
FIG. 24B is an enlarged schematic sectional view taken from FIG. 24A, which shows the arrangement of the gate lines and the data lines and the state of the gate and the source, which are connected to the gate lines and the data lines, of each thin film transistor.
Figure 25A:
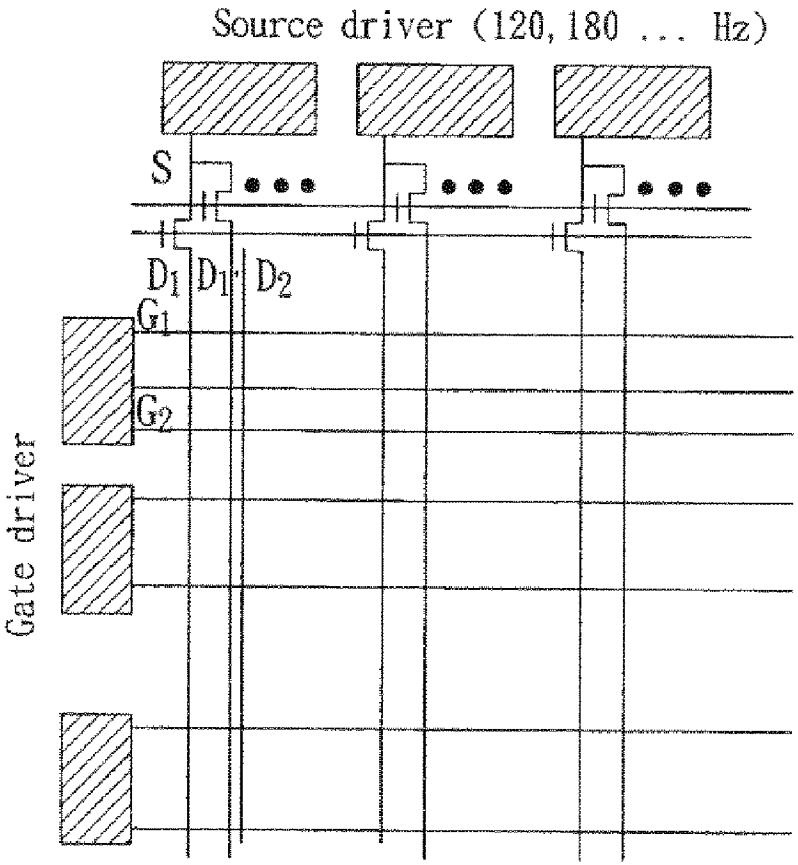
FIG. 25A is a schematic view of the arrangement of the gate lines and the data lines of the display panel of the sixth embodiment according to the present invention, which shows the state of each pair of data lines connected to a source driver which is connected to the electronic switch.
Figure 25B:
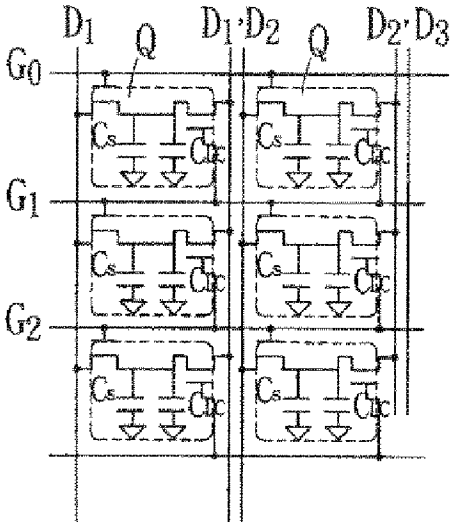
FIG. 25B is an enlarged schematic sectional view taken from FIG. 25A, which shows the arrangement of the gate lines and the data lines and the state of the gate and the source, which are connected to the gate lines and the data lines, of each thin film transistor.

Referring to FIG. 23A, the source drivers connected with, the data lines are installed on the same side. If the scanning frequency is 60 Hz and two gate lines are simultaneously turned, on, the scanning time can be further decreased. The source drivers can be arranged as shown in FIGS. 24A and 24B. The first data line of each group of data lines and the second data line of each group of data lines are respectively connected with the source drivers installed on the upper side and the lower side of the liquid crystal display. The scanning frequency of the source drivers is kept at 60 Hz. As shown in FIGS. 25A and 25B, the first data line of each group of data lines and the second data line of each group of data lines, which are neighboring, are connected with the same source driver. The data transfer is switched by an electronic switch. Its scanning frequency is a multiple of that of the said source driver, for examples, 120 Hz, 180 Hz . . . etc. The form of the gate driver can be a chip on glass, or an integrated gate driver circuit on glass.

Figure 26:
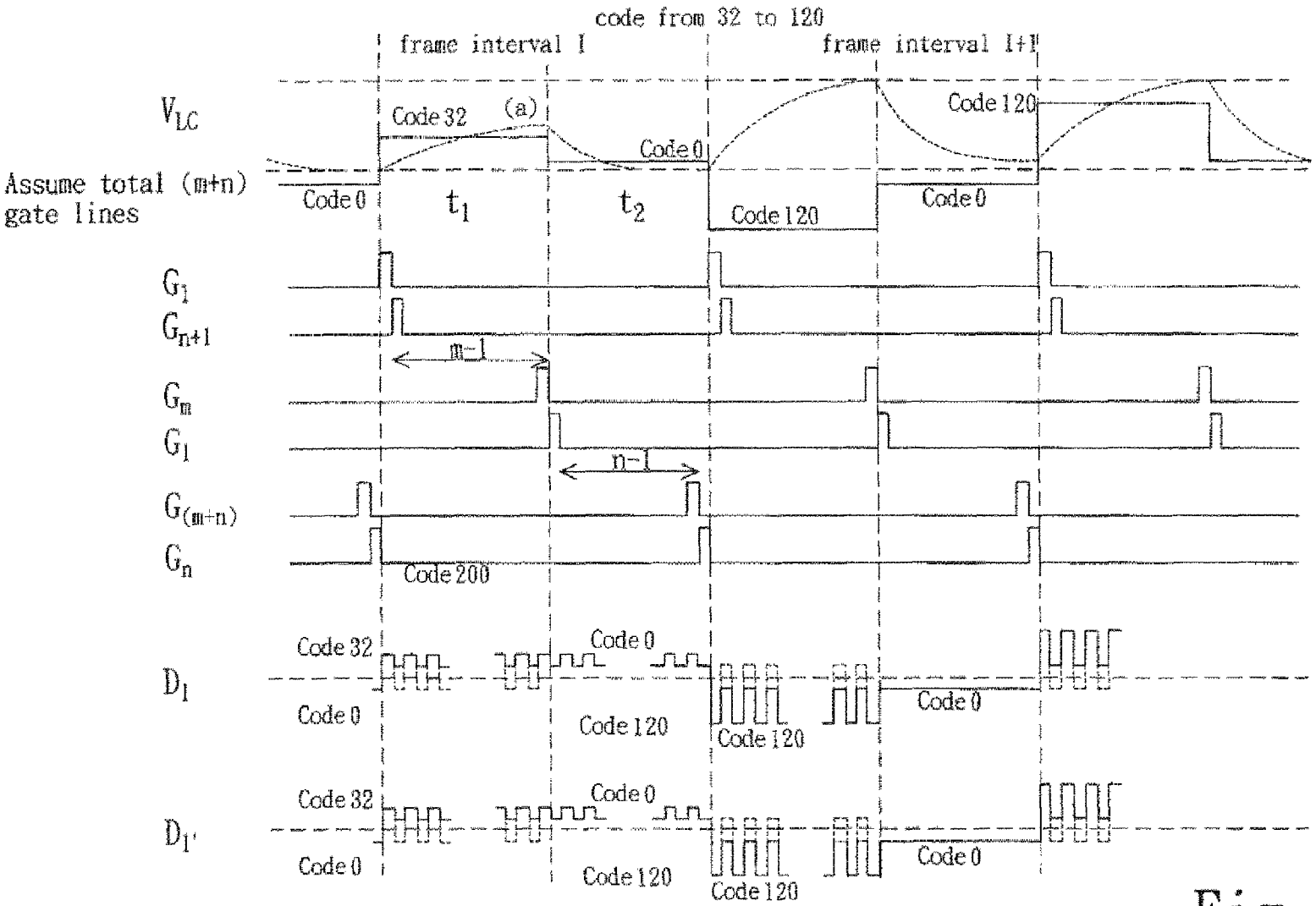
FIG. 26 is a wave form view of the signal used in the driving method of the display device of the sixth embodiment according to the present invention, which shows the variation of the wave form of the signal of the gate lines and the data lines from the gate driver and the source driver at different frame interval time.

The driving method of the present invention is executed with the device stated above. Referring to FIG. 26, when time enters the frame interval 1, the expected brightness is code 32 and $V_{LC}$ is the driving voltage pulse. The value of the driving voltage is expressed with, code in the following statement to prevent the driving voltage from confusing the alternating voltage for driving liquid crystal. In FIG. 26, curve (a) expresses the brightness variation of the pixel after being driven.

If there are m+n, i.e. N=m+n, gate lines in the liquid crystal display, the period of the voltage of displaying the present frame interval data received by the thin film transistor connected with the first gate line is set as the displaying brightness period $t_1$ and the period of the voltage of displaying black image received by the thin film transistors connected with the first gate line is set as the displaying black image period $t_2$.

When time enters the displaying brightness period $t_1$, the first and the $n+1^{th}$ gate lines $G_1$, $G_{n+1}$ are orderly turned on in a time of one synchronous control signal. The voltage code 32 of displaying the present frame interval data and the voltage code 0 of displaying black image are respectively given to the thin film transistors Q connected with the said gate lines. The second and the $n+2^{th}$ gate lines, the third and the $n+3^{th}$ gate lines . . . and the $m+n-1^{th}$ and the $m^{th}$ gate lines are orderly and synchronously turned on in the time of synchronous control signal. The voltage code 32 of displaying the present frame interval data is given to the thin film transistors connected with the second to the $m^{th}$ gate lines. The voltage code 0 of displaying black image is given to the thin film transistors Q connected with the $n+2^{th}$ to the $m+n-1^{th}$ gate lines.

When time enters the displaying black image period $t_2$, the first gate line and the $m+1^{th}$ gate line are orderly turned on in a time of one synchronous control signal. The voltage code 32 of displaying the present frame interval data and the voltage code 0 of displaying black image are respectively given to the thin film transistors Q connected with the said gate lines. The second and the $m+2^{th}$ gate lines, the third and the $m+3^{th}$ gate lines . . . and the $m+n^{th}$ (i.e. the last) and the $n^{th}$ gate lines are orderly turned on. The voltage code 32 of displaying the present frame interval data is given to the thin film transistors Q connected with the $m+2^{th}$ to the $m+n^{th}$ (the last) gate lines.

The voltage code 0 of displaying black image is given to the thin film transistors Q connected with the second to the $n^{th}$ gate lines.

If the number of the gate lines scanned in the displaying brightness period $t_1$ to the number of the total gate lines is P and the frame interval time of the liquid crystal display is T, then the displaying brightness duration is PT and the keeping brightness duration is (1−p)T. The ratio P can be adjusted according to the characteristic of the display panel.

When time enters the next frame interval I+1 and the expected brightness is code 120, the steps stated above can be repeated and the object of quickly changing the gray level of the liquid crystal display can be accomplished.

The present invention can quickly drive the liquid crystal display and quickly change the display value of the gray level of the liquid crystal display by the division of the time (frame interval time) and space (gate lines) and the application of the voltage of displaying the present frame brightness and the voltage of displaying black image in the steps stated above. The driving method according to the present invention can suit for various picture treatments of liquid crystal display, organic light emitting diode (OLED) display or plasma display panel (PDP).

The "frame in frame" technique of the present invention, has been described by the above embodiments, but they cannot be used to limit the present invention. Any persons skilled at the art related to the present invention can make partial modification and variation without departing from the spirit and the scope of the present invention. The patent scope of the present invention should take the accompanying claims as the criterion.

Therefore, the present invention has the following advantages:

1. The liquid crystal display driven by the driving method of quickly changing the gray level according to the present invention can improve the phenomenon of the afterimage in the traditional liquid crystal display and keep the advantages in the traditional CRT display, hence it possesses good effect in visual feeling.
2. Besides dividing the scanning area of the display panel, the ratio of each scanning area can be adjusted and kept according to the characteristic of the panel. The present invention can suit for various display panels and possesses very high utilization value in industry.
3. The present invention can avoid the electromagnetic interference and the high equipment cost due to the technique of switching the back light source in the prior art by the application of the driving voltage for displaying black image.

To sum up, the present invention indeed can accomplish its expected object of providing a driving device for quickly changing the gray level of the liquid crystal display and its driving method. The present invention has the advantage of the image display in the traditional CRT display and can improve the drawback of the image display of the liquid crystal display. Therefore the present invention has very high utilization value in industry, so it is brought forward claiming patent right.

What is claimed is:

1. A driving method, for quickly changing the gray level of a liquid crystal display, which includes;

a. making use of a liquid crystal display driving device, the driving device comprising:

a group of thin film transistors with matrix array, which consist of N rows and 2M columns of thin film transistors, wherein each pair of neighboring thin film transistors can drive one pixel, therefore, total N×M of pixels can be driven;

N groups of gate lines connected with the gate drivers and insulated with each other, wherein the first and the second gate line of the first group of gate lines are respectively connected with the gates of all the thin film transistors of the odd column and the even column of the first row, the first and the second gate lines of the second group of gate lines are respectively connected with the gates of all the thin film transistors of the odd column and the even column of the second row . . . and the first and the second gate lines of the $N^{th}$ group of gate lines are respectively connected with the gates of all the thin film transistors of the odd column and the even column of the $N^{th}$ row; and a group of 2M data lines connected with the source drivers and insulated with each other, wherein the first data line is connected with the sources of all the thin film transistors of the first column, the second data line is connected with the sources of all the thin film transistors of the second column . . . and the $2M^{th}$ data line is connected with the sources of all the thin film transistors of the $2M^{th}$ column, wherein there are 2(m+n), i.e. N=2(m+n), gate lines in the liquid crystal display, the period of the voltage of displaying the present frame interval data received by the thin film transistors connected with the first gate line of the first group of gate lines is set as the displaying brightness period, and the period of the voltage of displaying black image received by the thin film transistors connected with the second gate line of the first group of gate lines is set as the displaying black image period;

b. when time enters the displaying brightness period, the first gate line of the first group of gate lines and the second gate line of the nth group of gate lines are orderly turned on in a time of one synchronous control signal, the voltage of displaying the present frame interval data and the voltage of displaying black image are respectively given to the thin film transistors connected with the said, gate lines, and the first gate line of the second group of gate lines and the second gate line of the $n+1^{th}$ group of gate lines, the first gate line of the third group of gate lines and the second gate line of the $n+2^{th}$ group of gate lines . . . and the second gate line of the $m+n-1^{th}$ group of gate lines and the first gate line of the $m+1^{th}$ group of gate lines are orderly turned on in a time of the synchronous control signal the voltage of displaying the present frame interval data is given to the thin film transistors connected with, the first gate line of the second group to the $m+1^{th}$ group of gate lines, the voltage of displaying black image is given to the thin film transistors connected with the second gate line of the $n+1^{th}$ group to the $m+n-1^{th}$ group of gate lines;

c. when time enters the displaying black image period, the second gate line of the first group of gate lines and the first gate line of the $m+2^{th}$ group of gate lines are orderly turned on in a time of one synchronous control signal the voltage of displaying black image and the voltage of displaying the present frame interval data are respectively given to the thin film transistors connected with the said gate lines, and the first gate line of the $m+3^{th}$ group of gate lines and the second gate line of the second group of gate lines, the first gate line of the $m+4^{th}$ group of gate lines and the second gate line of the third group of gate lines . . . and the first gate line of the $m+n^{th}$ group of gate lines and the second gate line of the $n-1^{th}$ group of gate lines are orderly and synchronously turned on, the voltage of displaying black image is given to the thin film transistors connected with the second gate line of the second group to the $n-1^{th}$ group of gate lines, the voltage of displaying the present frame interval data is given to the thin film transistors connected with the first gate line of the $m+3^{th}$ group to the $m+n_{th}$ group of gate lines;

by using of the steps stated above, the gray level of the liquid crystal, display can be quickly changed.

2. A driving method for quickly changing the gray level of the liquid crystal display as claimed in claim 1, wherein the black image is the relatively black image and can be changed according to the background brightness by adjusting the voltage.

3. A driving method for quickly changing the gray level of the liquid crystal display as claimed in claim 1, wherein the driving method can also suit for the active matrix type liquid crystal display, the organic light emitting diode (OLED) display or plasma display panel (PDF).

* * * * *